US008128311B2

(12) United States Patent
Son et al.

(10) Patent No.: US 8,128,311 B2
(45) Date of Patent: Mar. 6, 2012

(54) GRASS PROTECTION MAT AND MAT ASSEMBLY HAVING THE SAME

(75) Inventors: Chang-Sub Son, Sungnam (KR); Sang-Geun Kim, Gwangsan-gu (KR)

(73) Assignee: Chang-Sub Son, Kyungki-Do (KR)

( * ) Notice: Subject to any disclaimer, the term of this patent is extended or adjusted under 35 U.S.C. 154(b) by 207 days.

(21) Appl. No.: 11/793,588

(22) PCT Filed: Oct. 12, 2005

(86) PCT No.: PCT/KR2005/003388

§ 371 (c)(1),
(2), (4) Date: Jun. 21, 2007

(87) PCT Pub. No.: WO2006/080751

PCT Pub. Date: Aug. 3, 2006

(65) Prior Publication Data

US 2008/0052986 A1 Mar. 6, 2008

(30) Foreign Application Priority Data

Dec. 24, 2004 (KR) ..... 20-2004-0036756 U
Jan. 5, 2005 (KR) ..... 20-2005-0000218 U
Jun. 20, 2005 (KR) ..... 20-2005-0017707 U

(51) Int. Cl.
*E01C 9/08* (2006.01)
*E01C 5/00* (2006.01)
*B25G 3/18* (2006.01)

(52) U.S. Cl. ..... 404/36; 404/40; 403/326

(58) Field of Classification Search ..... 404/35, 404/36, 40; 411/457, 451.4, 451.3, 455, 411/451.1, 922, 923; 52/391, 155; 135/118; 403/326, 408.1

See application file for complete search history.

(56) References Cited

U.S. PATENT DOCUMENTS 1,362,852 A * 12/1920 Dabis ..... 405/285
3,325,135 A * 6/1967 Clarke ..... 248/508
3,390,044 A * 6/1968 Malakoff ..... 428/17
3,438,312 A * 4/1969 Becker et al. ..... 404/40
3,959,542 A * 5/1976 Livermore ..... 428/44
4,430,837 A * 2/1984 Kirschenbaum ..... 52/506.05
4,461,131 A * 7/1984 Pressell ..... 52/395

(Continued)

FOREIGN PATENT DOCUMENTS

DE 2 251 762 5/1974

(Continued)

*Primary Examiner* — Thomas Will
*Assistant Examiner* — Abigail A Risic
(74) *Attorney, Agent, or Firm* — McDermott Will & Emery LLP

(57) ABSTRACT

A grass protection mat and a mat assembly having the same are provided. The grass protection mat of the invention includes a body made of polygonal portions, pillars protruded upward from the body, buffer wings protruded upward from the body between the pillars for distributing weights, an outer frame at the periphery of the body, lug members protruded from lower parts of the body and the outer frame. The mat also includes slide-type hooking means laterally protruded for connection of the mats, an opening formed at the inner surface of the outer frame. The mat assembly includes various forms of mat fastening members for connecting the grass protection mats. The invention facilitates connection of the mats and enhances assemblability of the mat assembly, effectively preventing sinking of the mats into the ground, thereby maintaining protection of grass.

15 Claims, 23 Drawing Sheets

U.S. PATENT DOCUMENTS

| | | | | | |
|---|---|---|---|---|---|
| 4,478,901 | A | * | 10/1984 | Dickens et al. | 428/120 |
| 4,584,221 | A | * | 4/1986 | Kung | 428/44 |
| 4,589,224 | A | | 5/1986 | Collette | |
| 4,596,731 | A | | 6/1986 | Cudmore et al. | |
| RE32,663 | E | * | 5/1988 | Atkinson | 405/19 |
| 4,917,532 | A | * | 4/1990 | Haberhauer et al. | 404/35 |
| 4,996,804 | A | * | 3/1991 | Naka et al. | 52/126.6 |
| 5,295,341 | A | * | 3/1994 | Kajiwara | 52/586.2 |
| 5,428,935 | A | * | 7/1995 | Mitchell | 52/698 |
| 5,853,844 | A | * | 12/1998 | Wen | 428/119 |
| 5,865,004 | A | * | 2/1999 | Mitchell | 52/582.1 |
| 6,418,690 | B1 | * | 7/2002 | Wheatley et al. | 52/480 |
| 6,451,400 | B1 | * | 9/2002 | Brock et al. | 428/44 |
| 6,585,449 | B2 | * | 7/2003 | Chen | 404/2 |
| 6,751,912 | B2 | * | 6/2004 | Stegner et al. | 52/177 |
| 6,896,439 | B2 | * | 5/2005 | Gasparotto | 403/293 |
| 6,962,464 | B1 | * | 11/2005 | Chen | 405/43 |
| 7,043,792 | B2 | * | 5/2006 | Kessler | 15/215 |
| 7,096,632 | B2 | * | 8/2006 | Pacione | 52/506.05 |
| 7,108,454 | B2 | * | 9/2006 | Blackwood | 405/36 |
| 7,108,902 | B2 | * | 9/2006 | Ellingson | 428/54 |
| 7,140,156 | B1 | * | 11/2006 | Lowe et al. | 52/263 |
| 7,201,538 | B2 | * | 4/2007 | Blackwood et al. | 405/50 |
| 7,303,801 | B2 | * | 12/2007 | Kessler | 428/54 |
| 7,603,826 | B1 | * | 10/2009 | Moebus | 52/592.1 |
| 2002/0122912 | A1 | * | 9/2002 | Brock et al. | 428/44 |
| 2003/0089051 | A1 | * | 5/2003 | Bertolini | 52/177 |
| 2004/0163336 | A1 | * | 8/2004 | Hsu | 52/157 |
| 2004/0202512 | A1 | * | 10/2004 | Smith | 405/259.1 |
| 2006/0265975 | A1 | * | 11/2006 | Geffe | 52/177 |

FOREIGN PATENT DOCUMENTS

| | | | |
|---|---|---|---|
| DE | 20008708 | * | 5/2000 |
| JP | 52-1730 | | 1/1977 |
| JP | 1-105435 | | 7/1989 |
| JP | 2-12242 | | 1/1990 |
| JP | 2-174611 | | 7/1990 |
| JP | 6-79236 | | 11/1994 |
| JP | 8-70699 | | 3/1996 |
| JP | 10-295201 | | 11/1998 |
| JP | 11-168995 | | 6/1999 |
| JP | 11-178462 | | 7/1999 |
| KR | 20-0295066 | | 10/2002 |
| KR | 20-0332243 | | 10/2003 |
| KR | 20-0346130 | | 3/2004 |
| KR | 20-0354896 | | 6/2004 |

* cited by examiner

[Fig. 1]
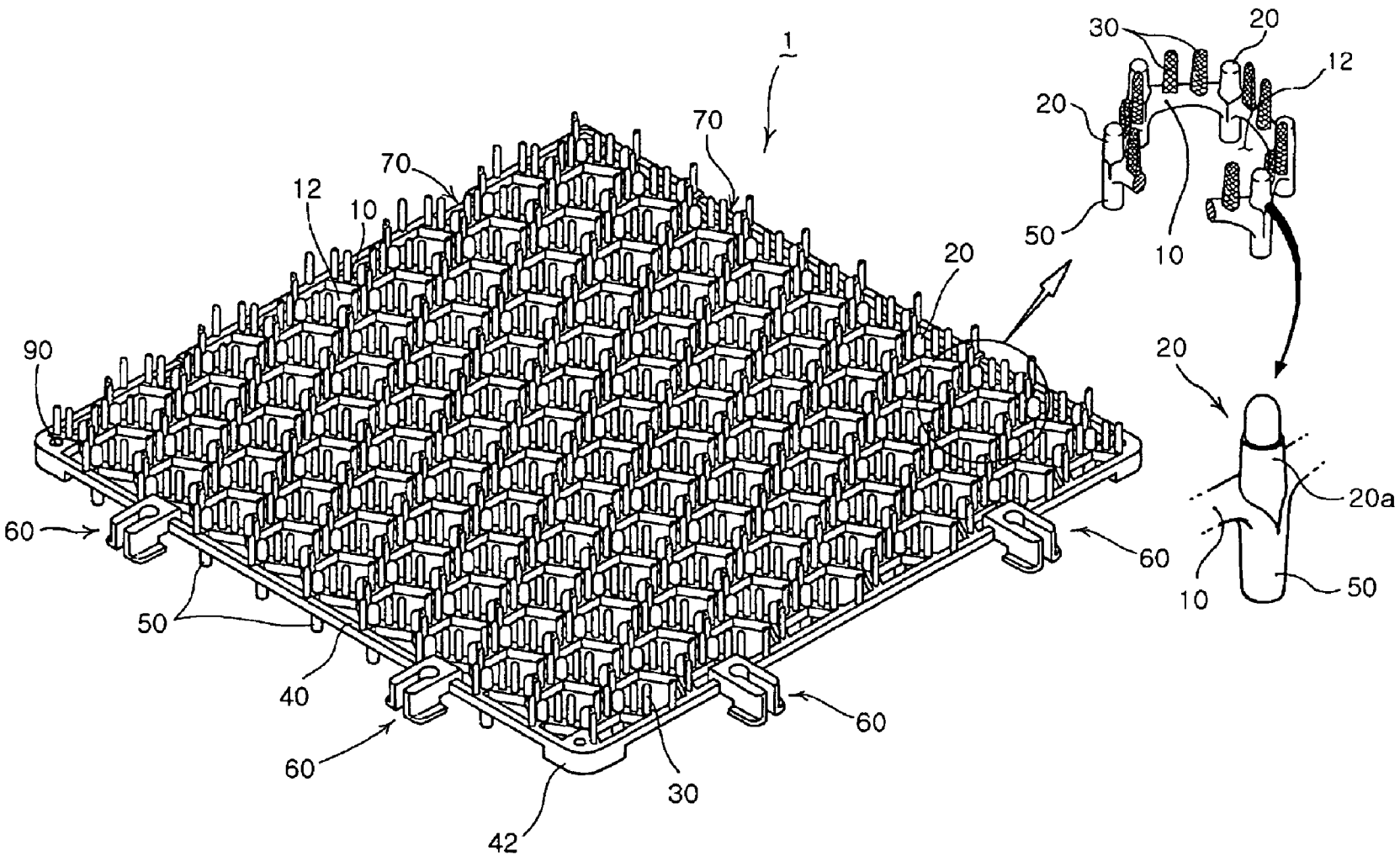

[Fig. 2]
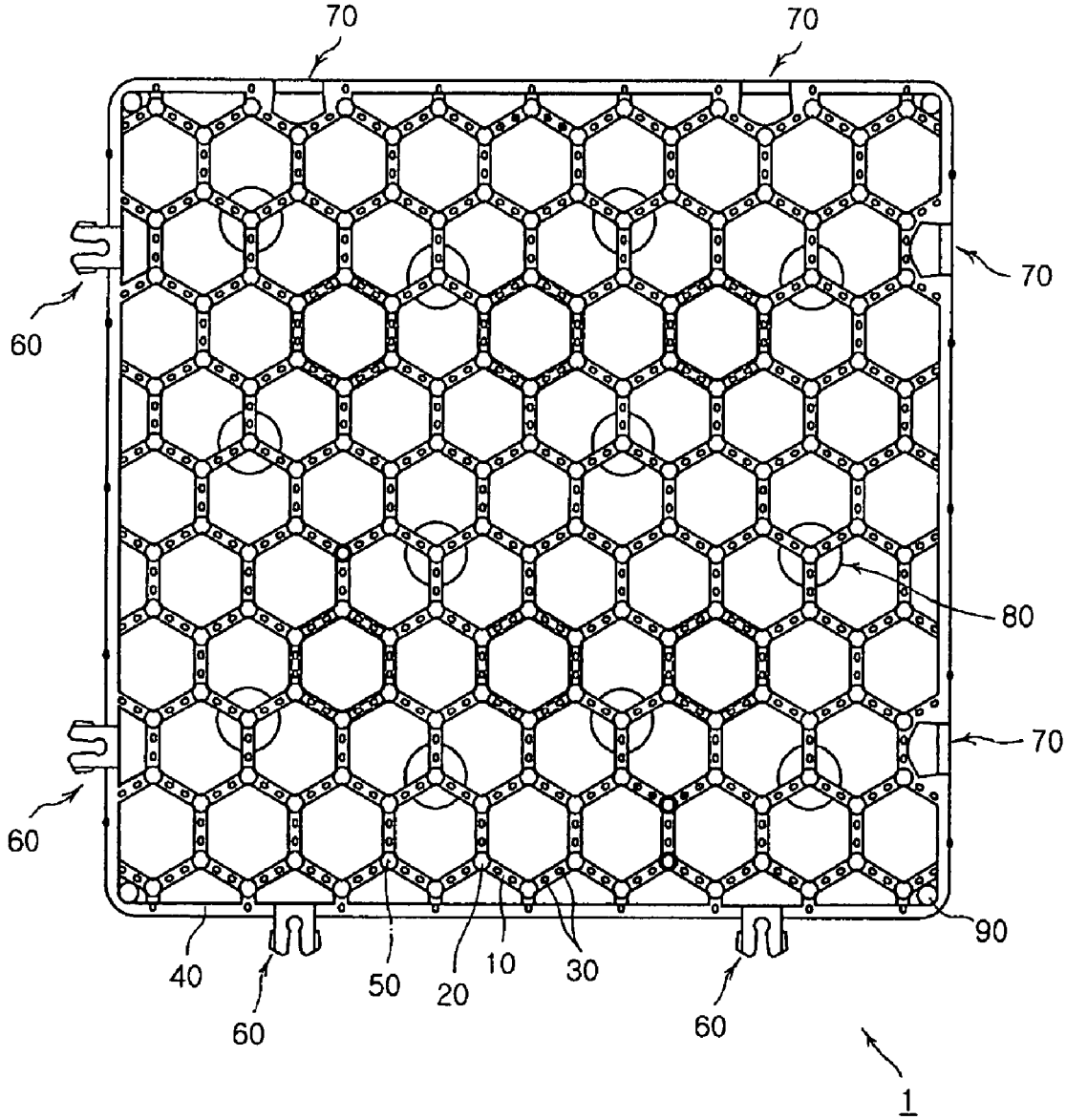

[Fig. 3]
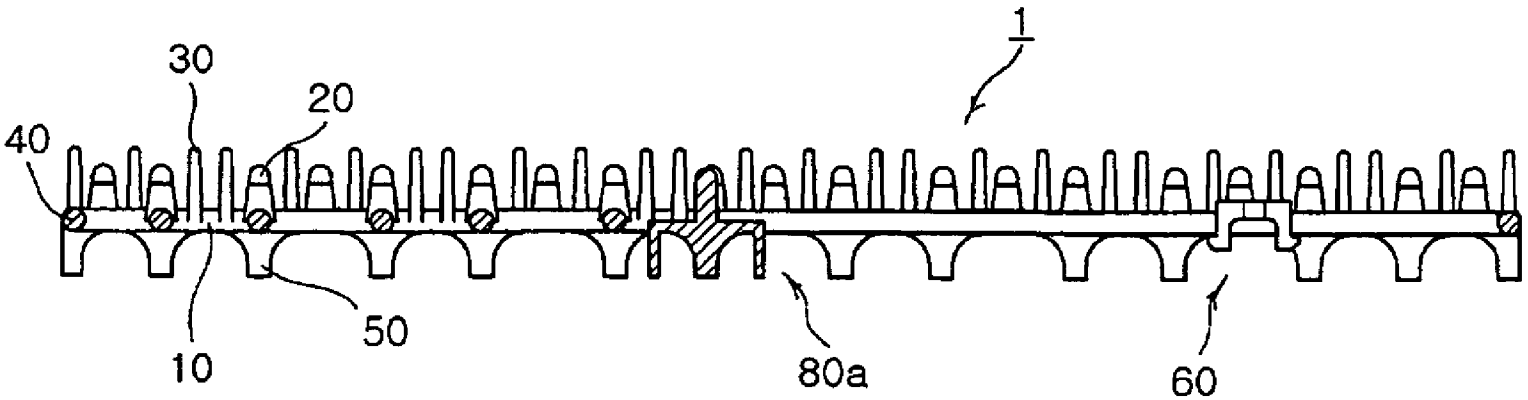

[Fig. 4]
(a)
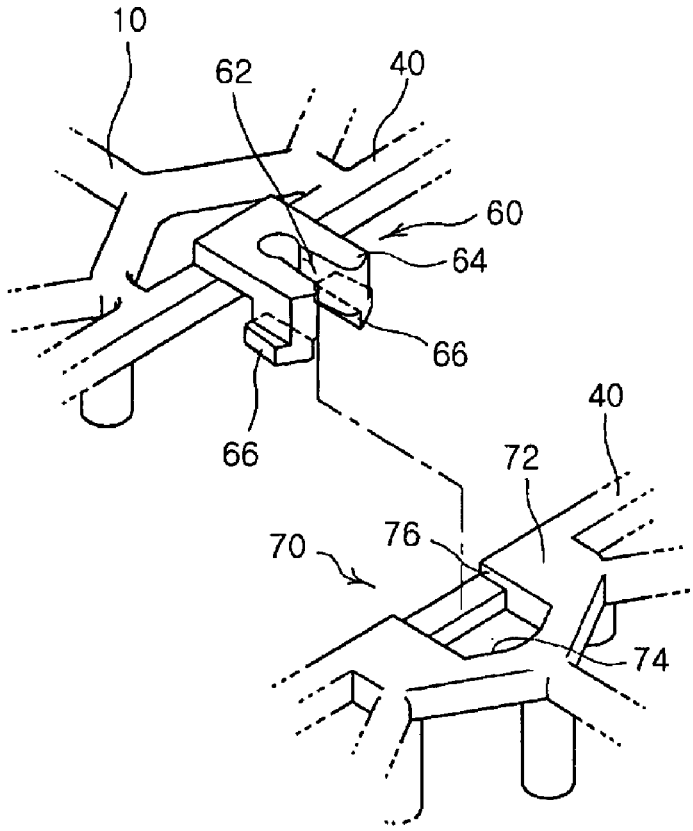
(b)
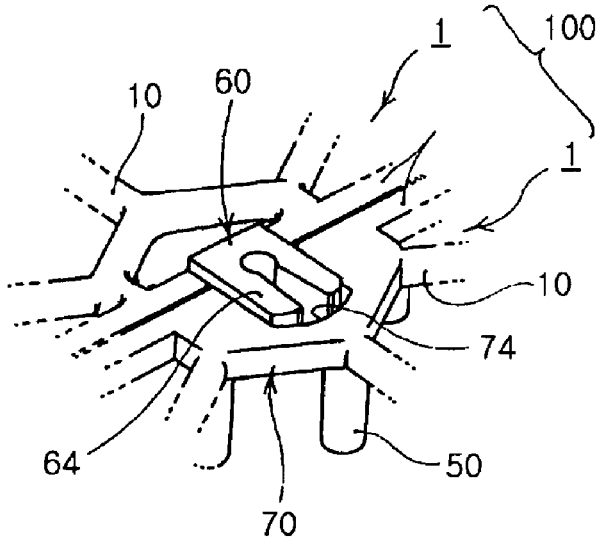

[Fig. 5]
(a)
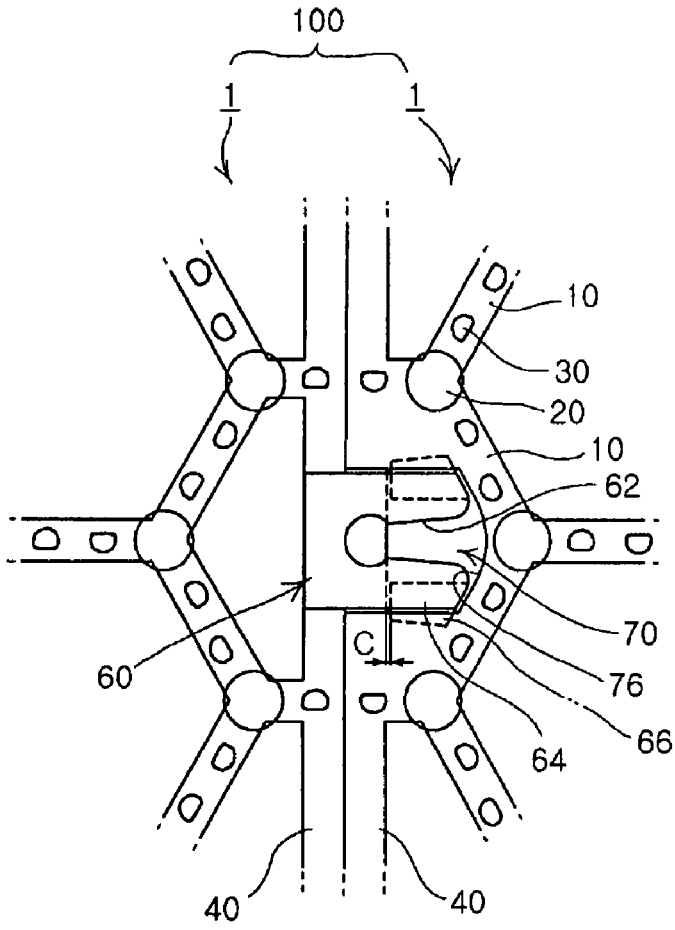
(b)
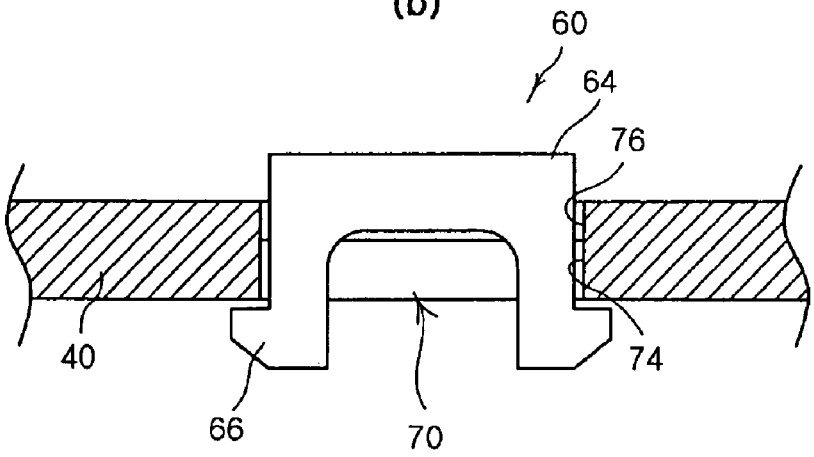

[Fig. 6]
(a)
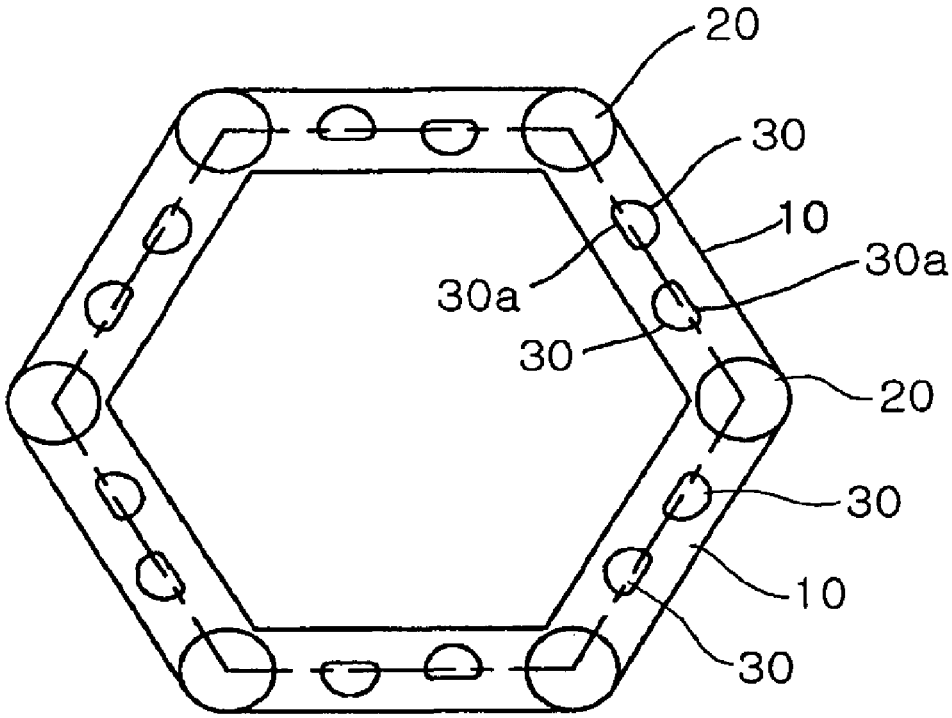
(b)
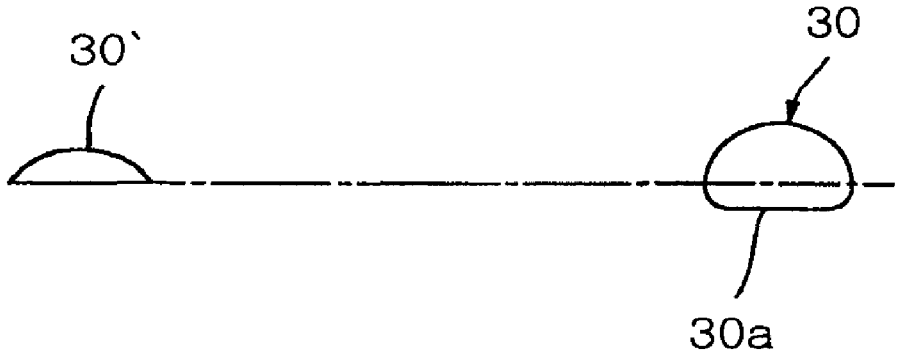

[Fig. 7]
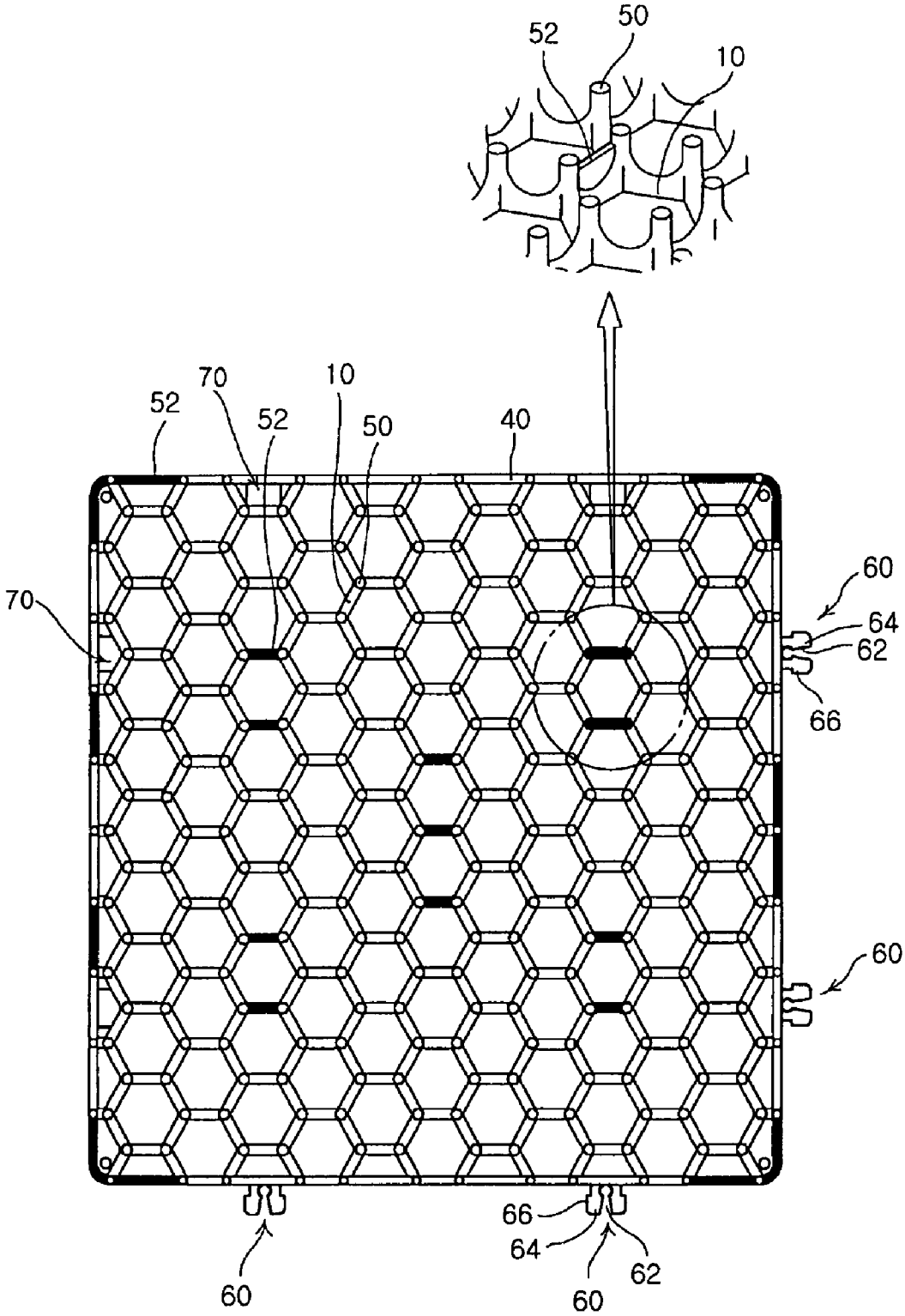

[Fig. 8]
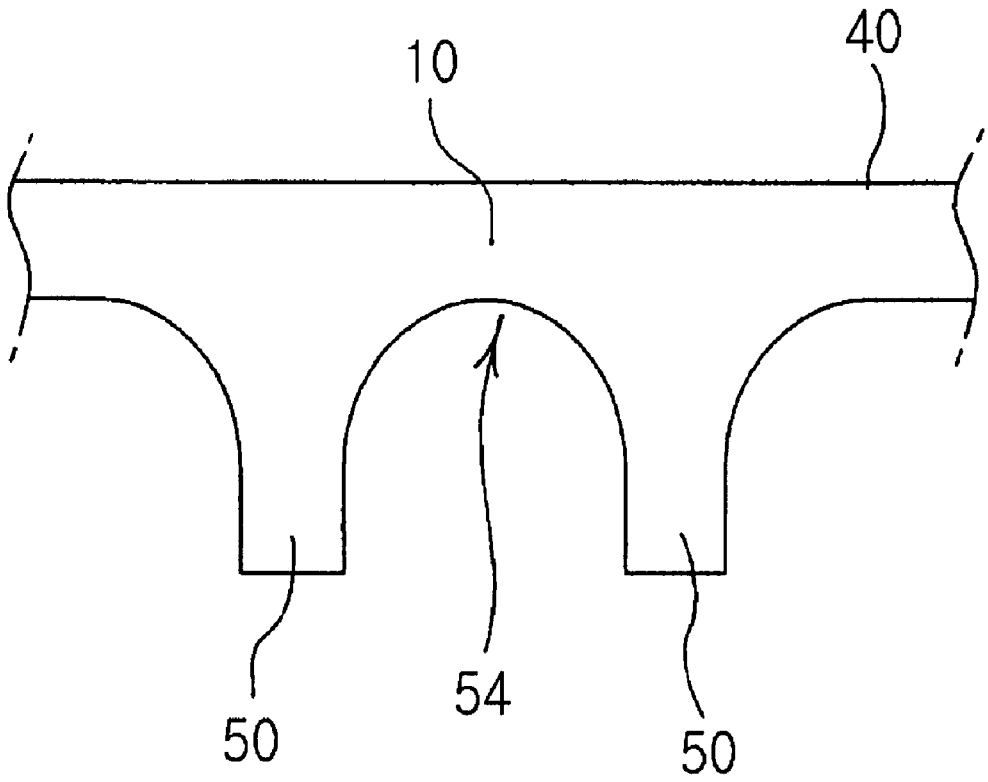

[Fig. 9]
(a)
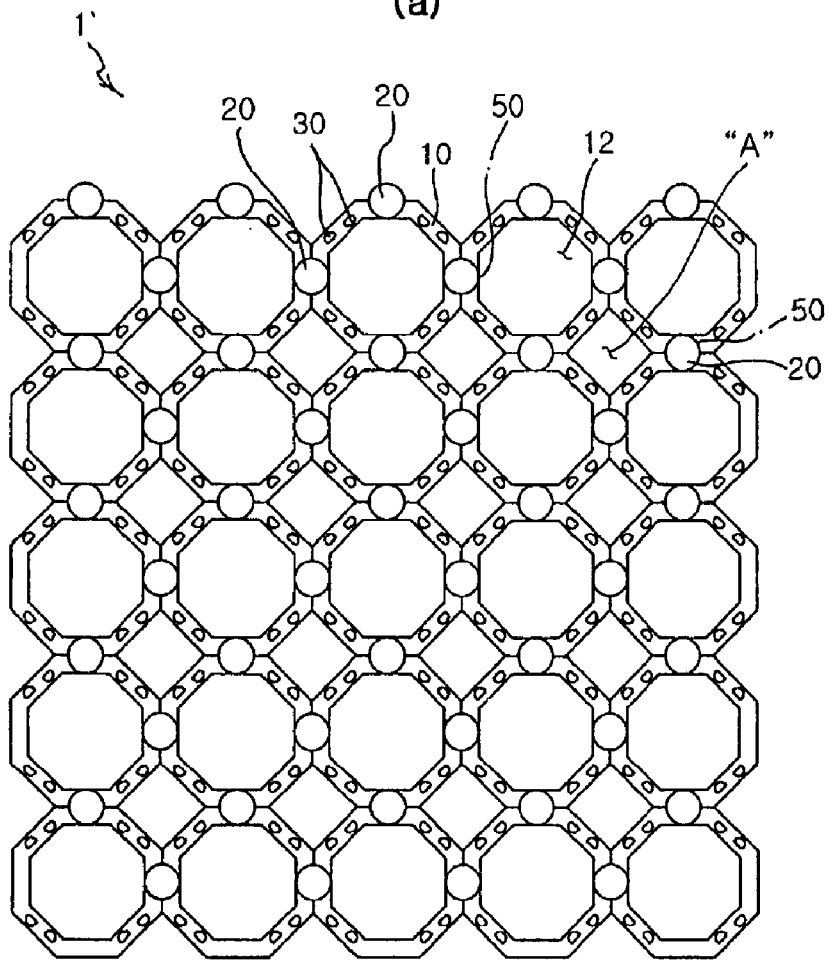
(b)
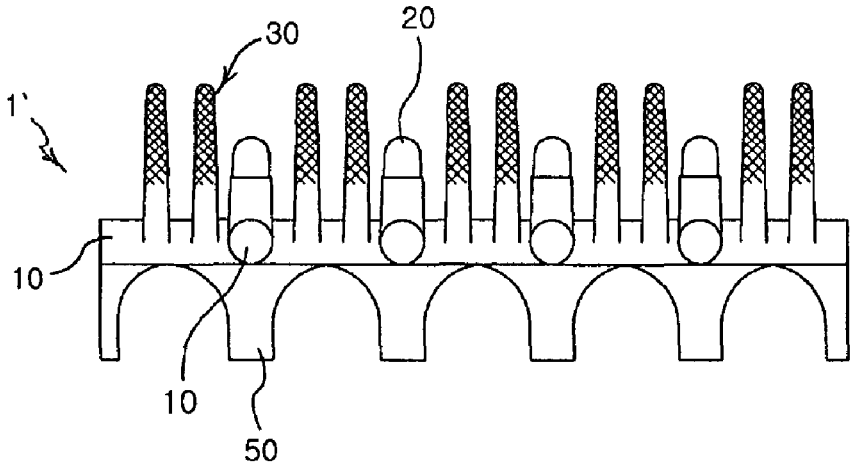

[Fig. 10]
(a)
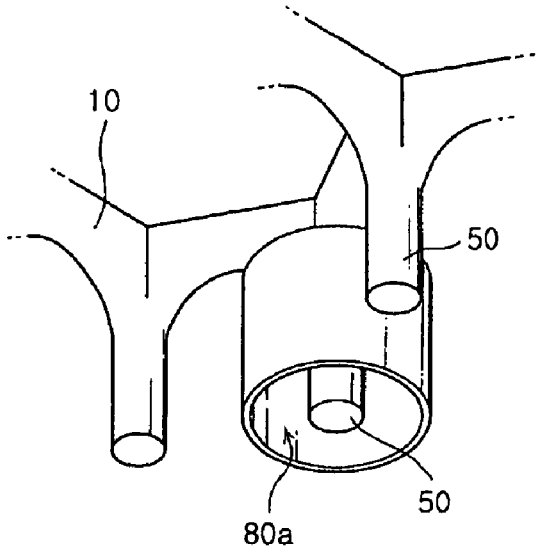
(b)
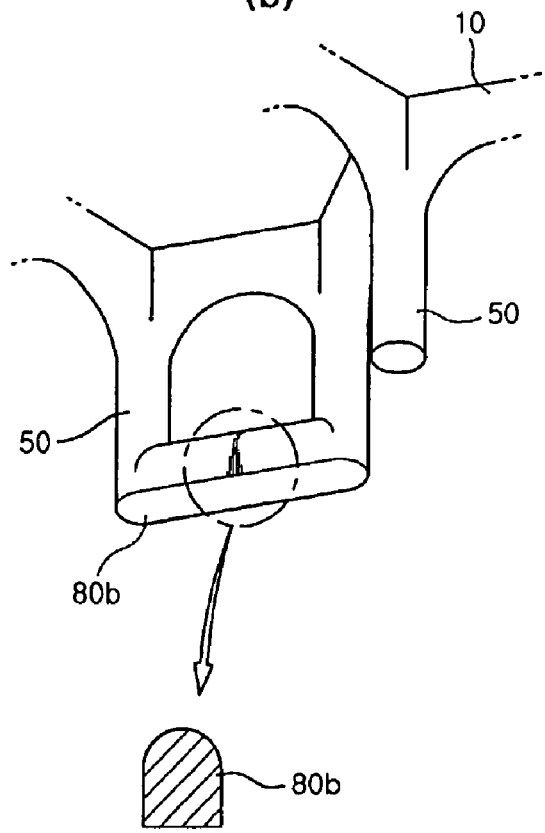

[Fig. 11]
(a)
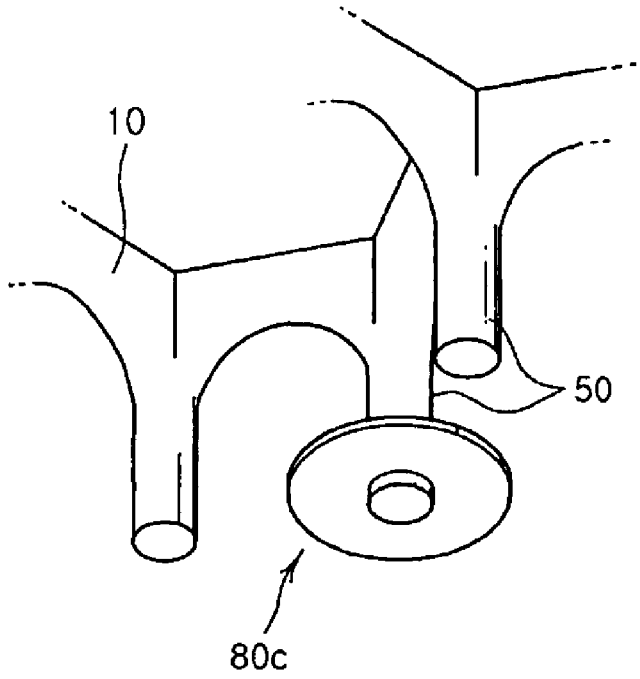
(b)
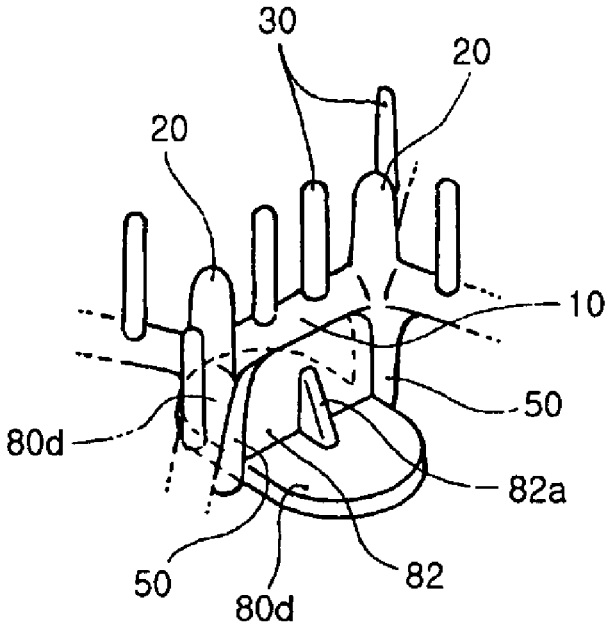

[Fig. 12]
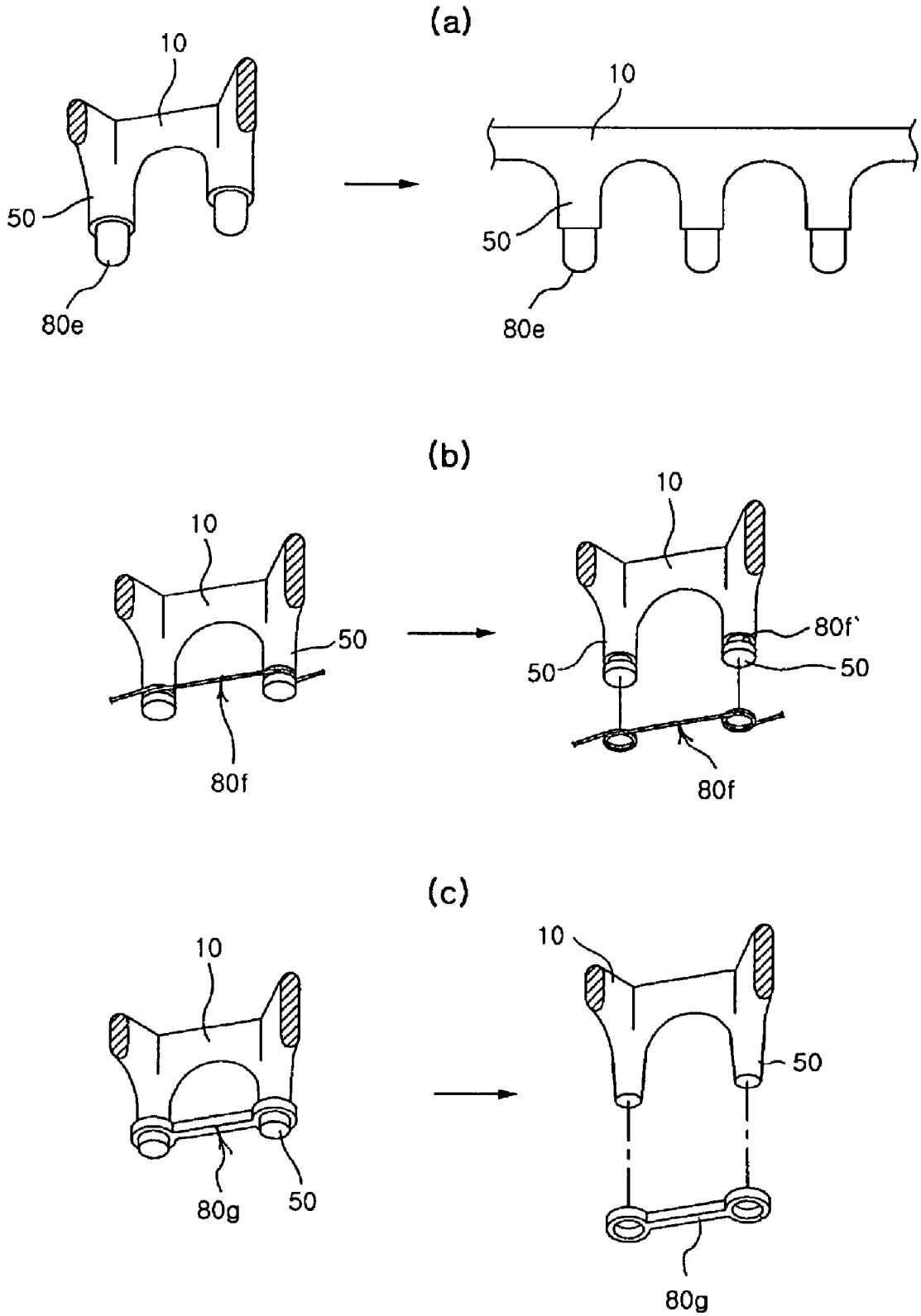

[Fig. 13]
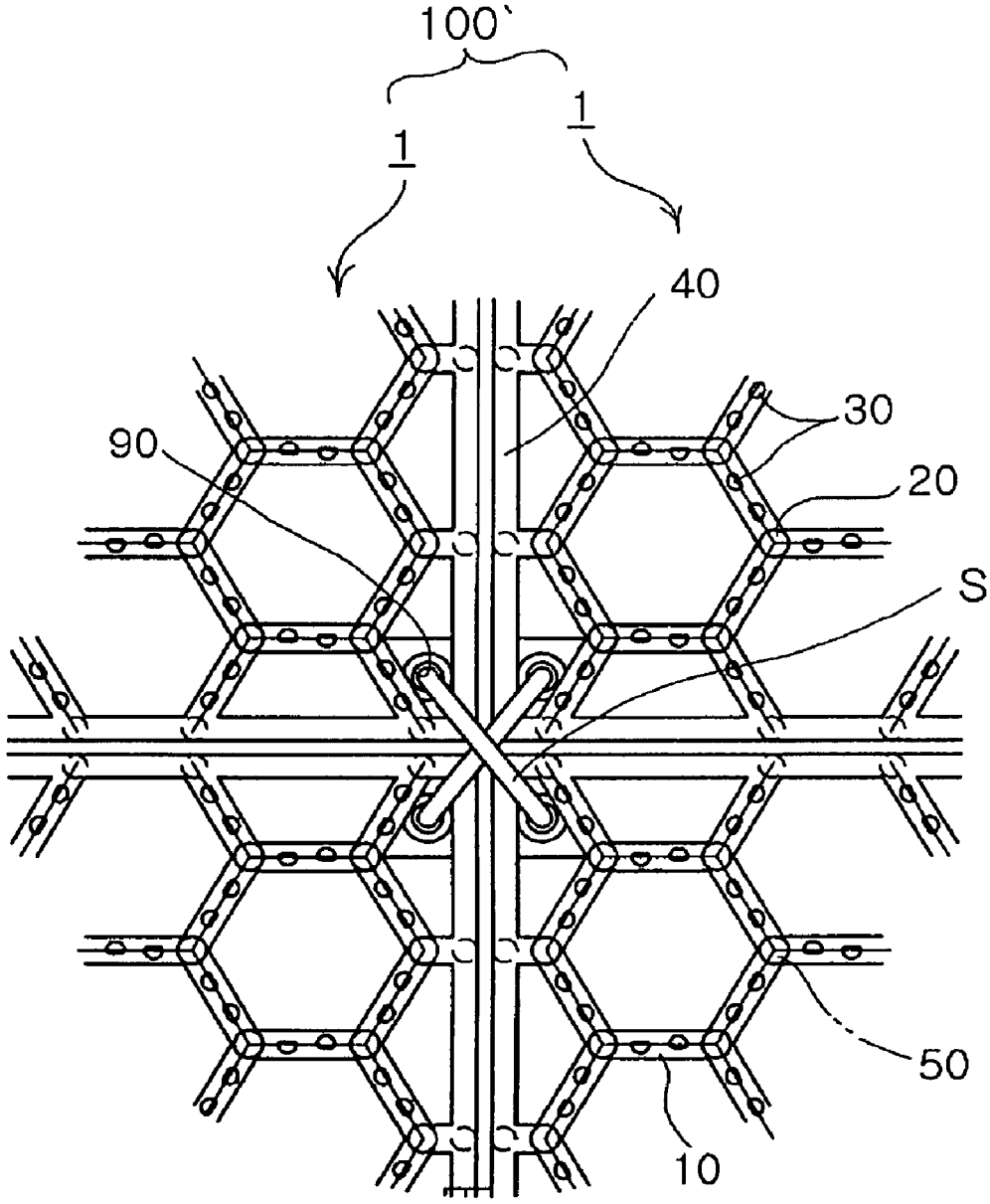

[Fig. 14]
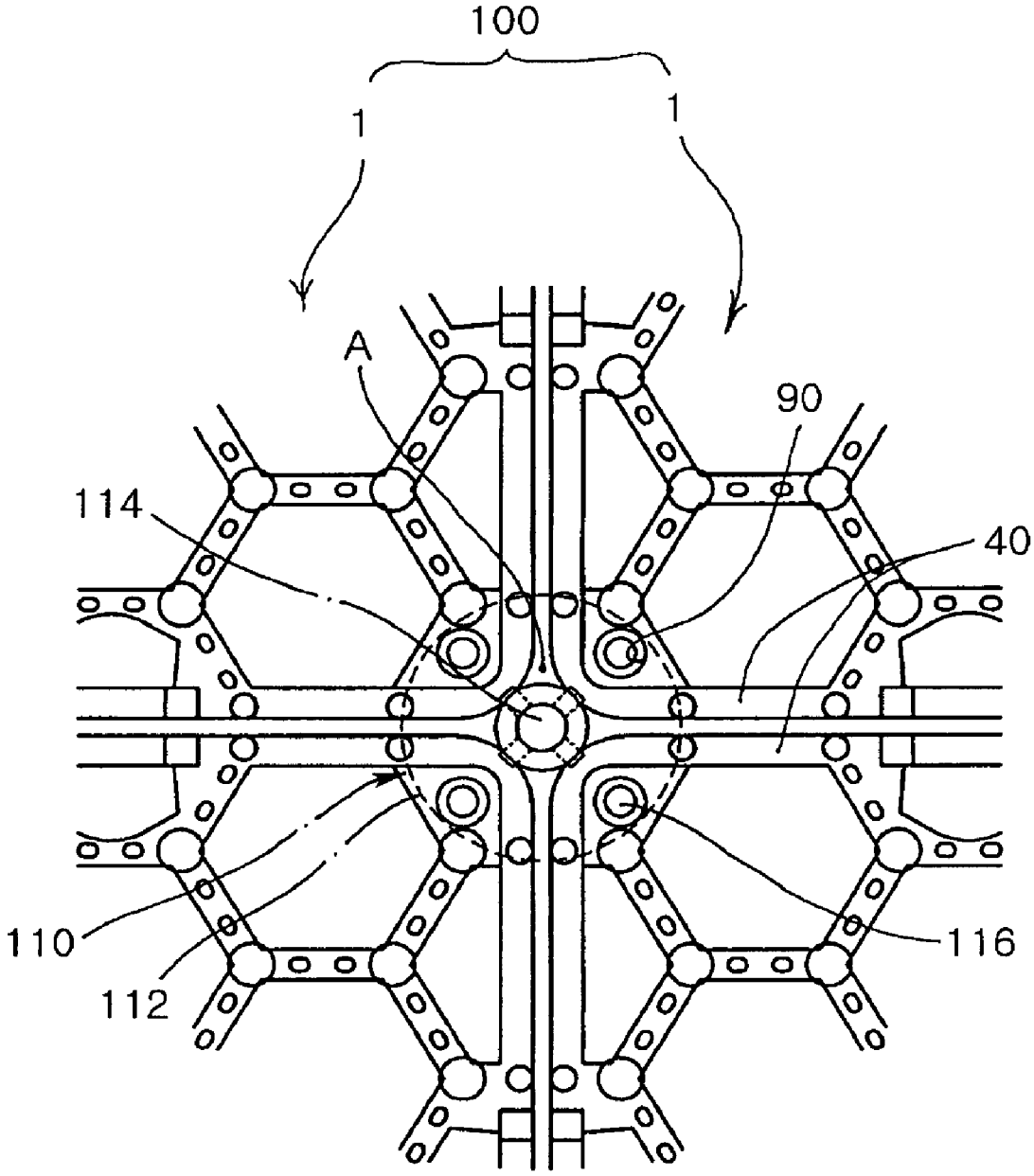

[Fig. 15]
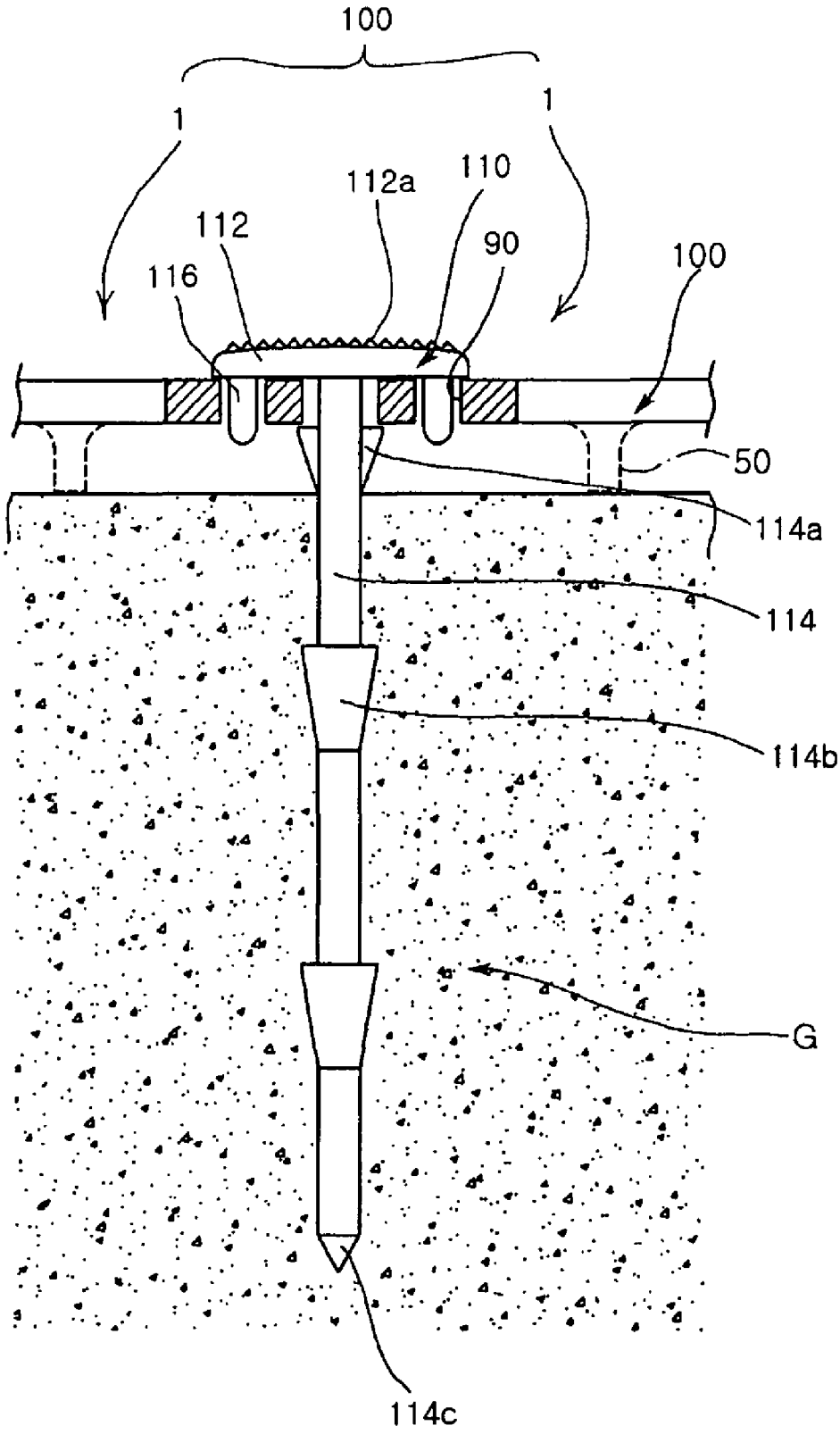

[Fig. 16]
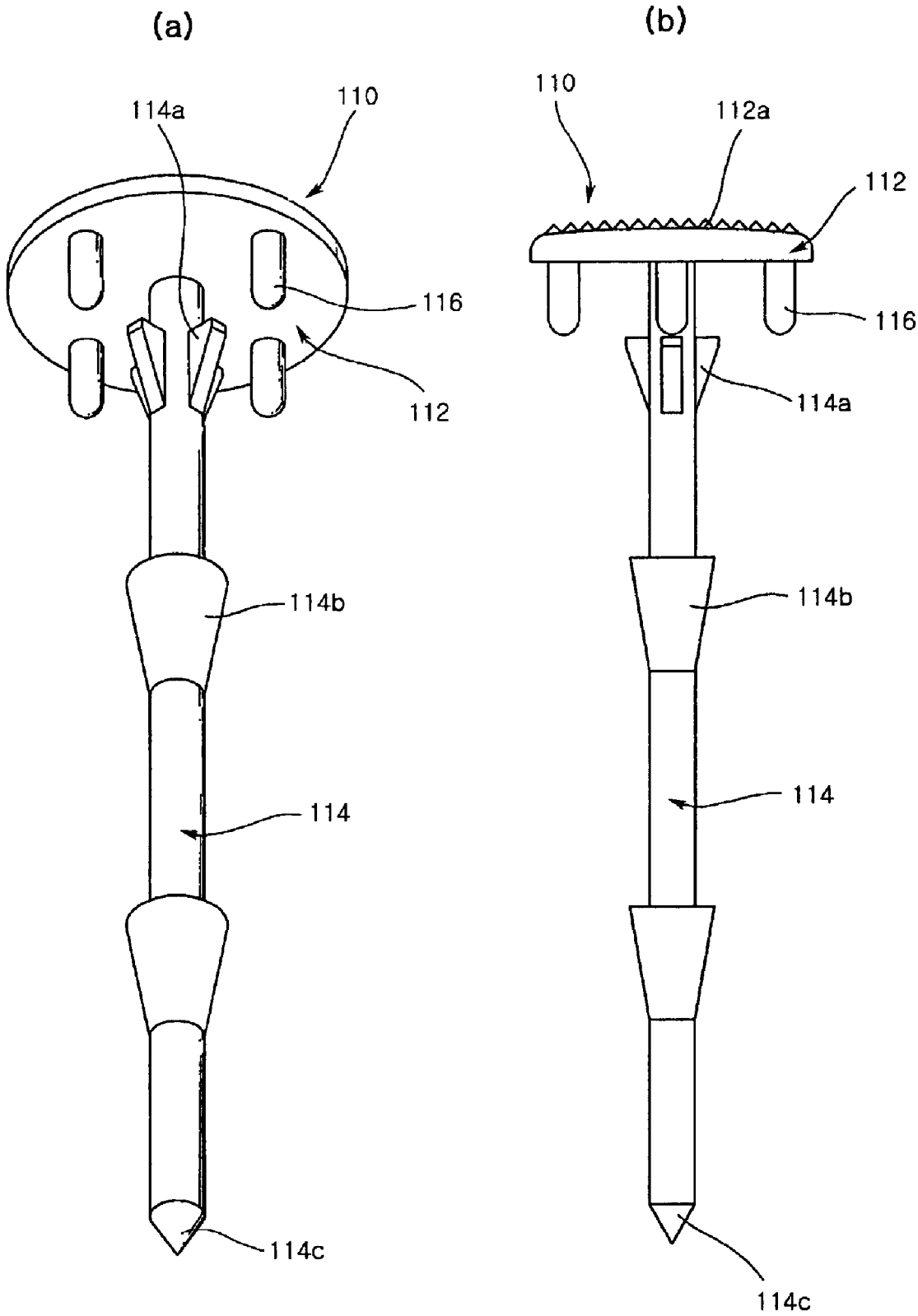

[Fig. 17]
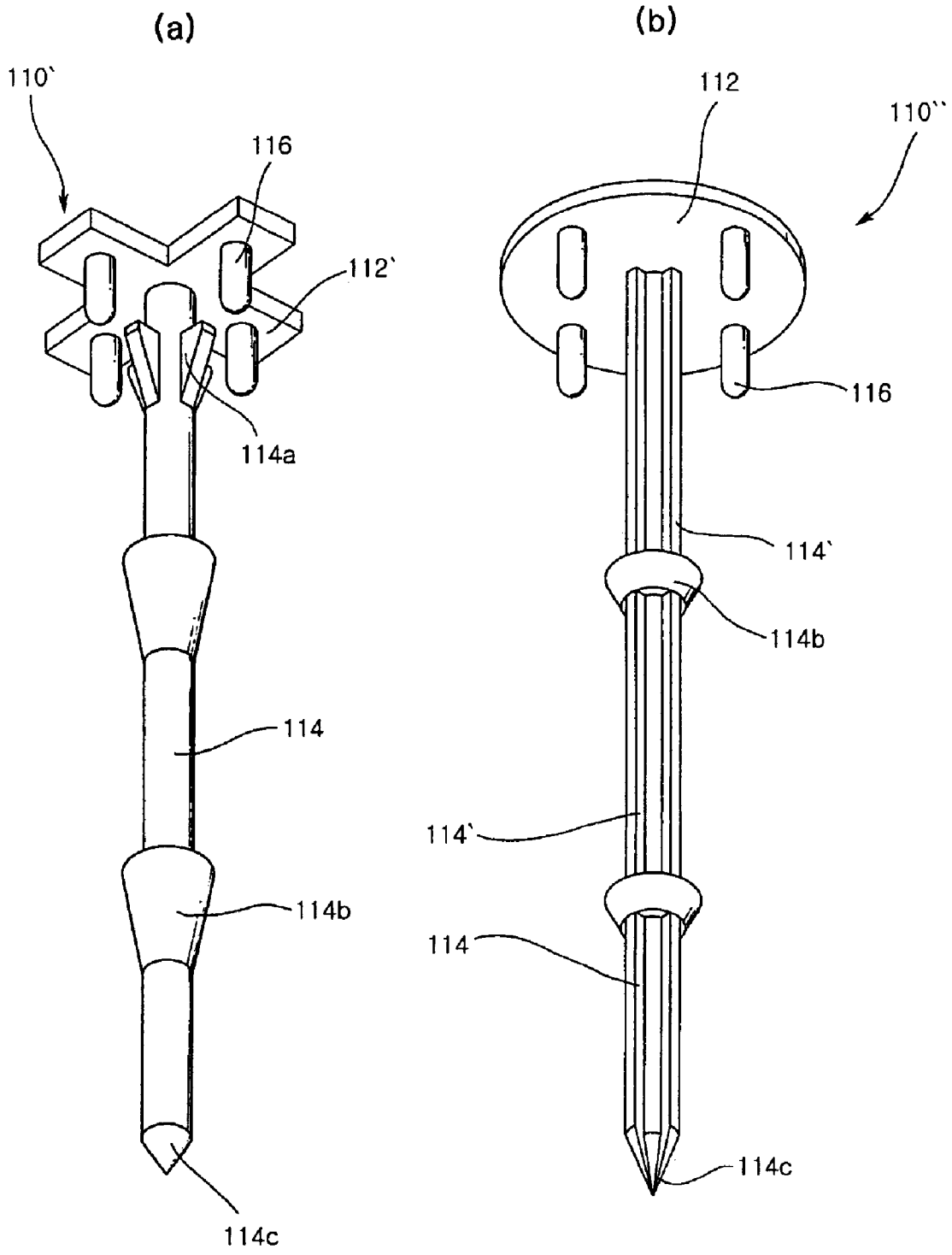

[Fig. 18]
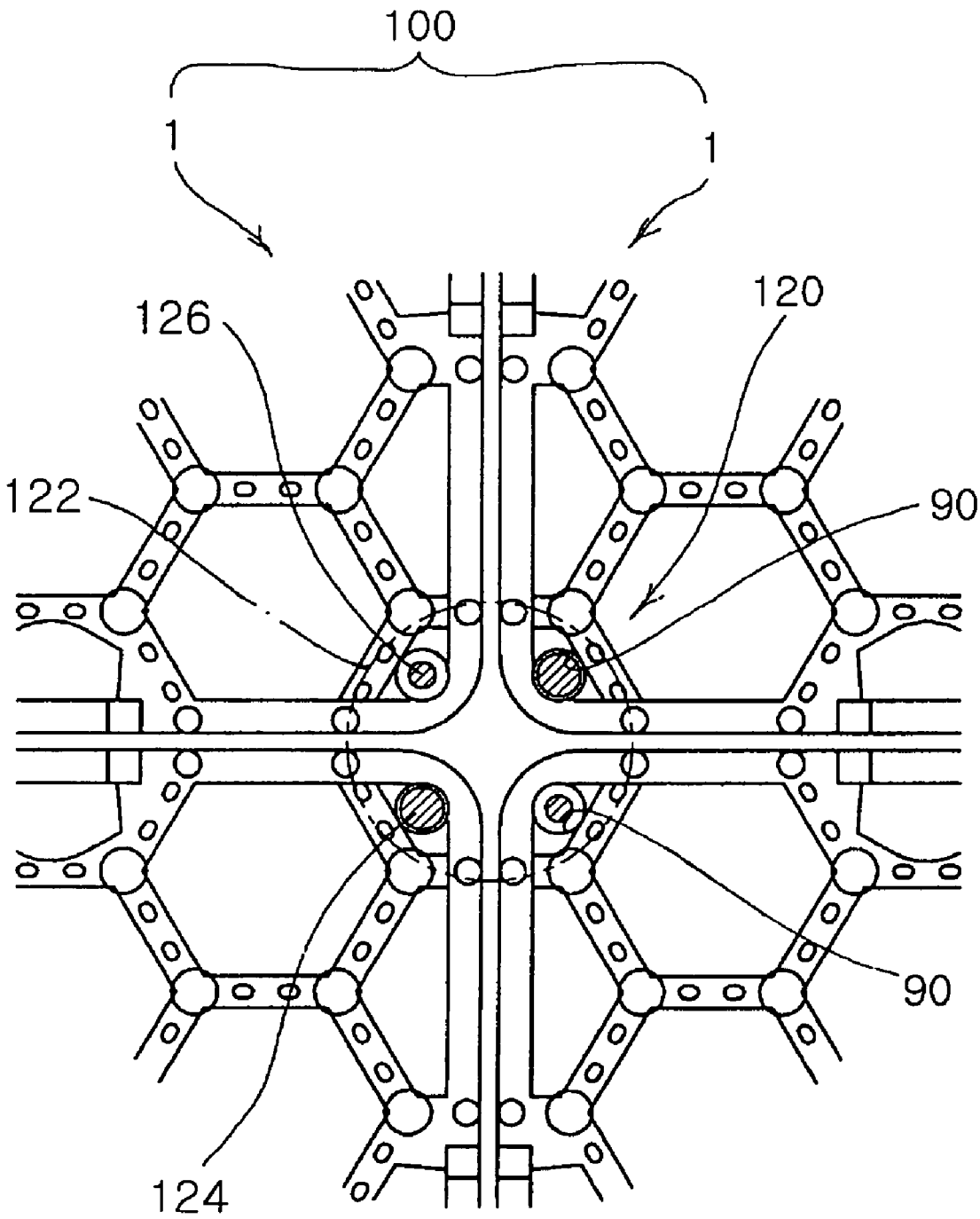

[Fig. 19]
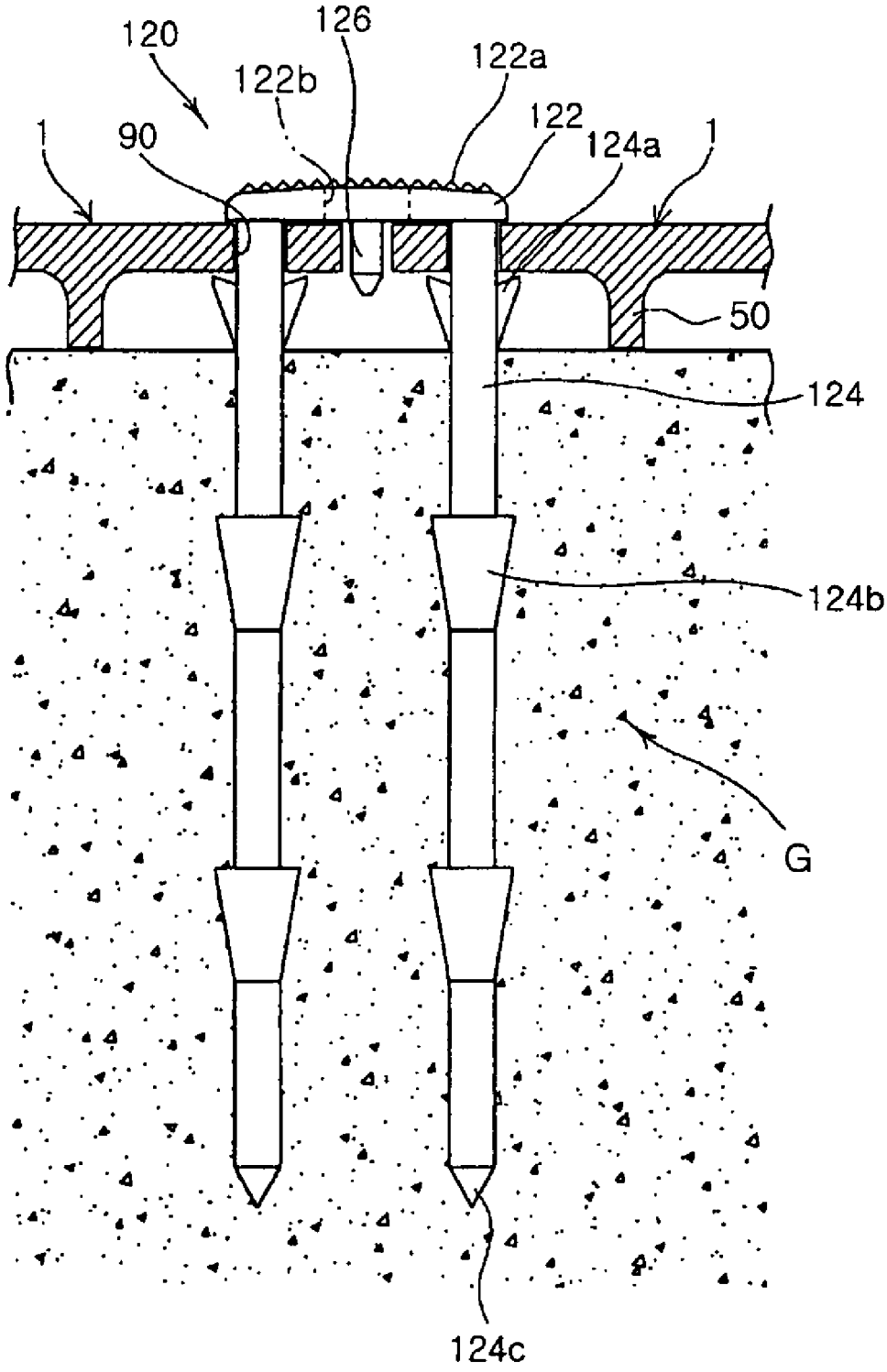

[Fig. 20]
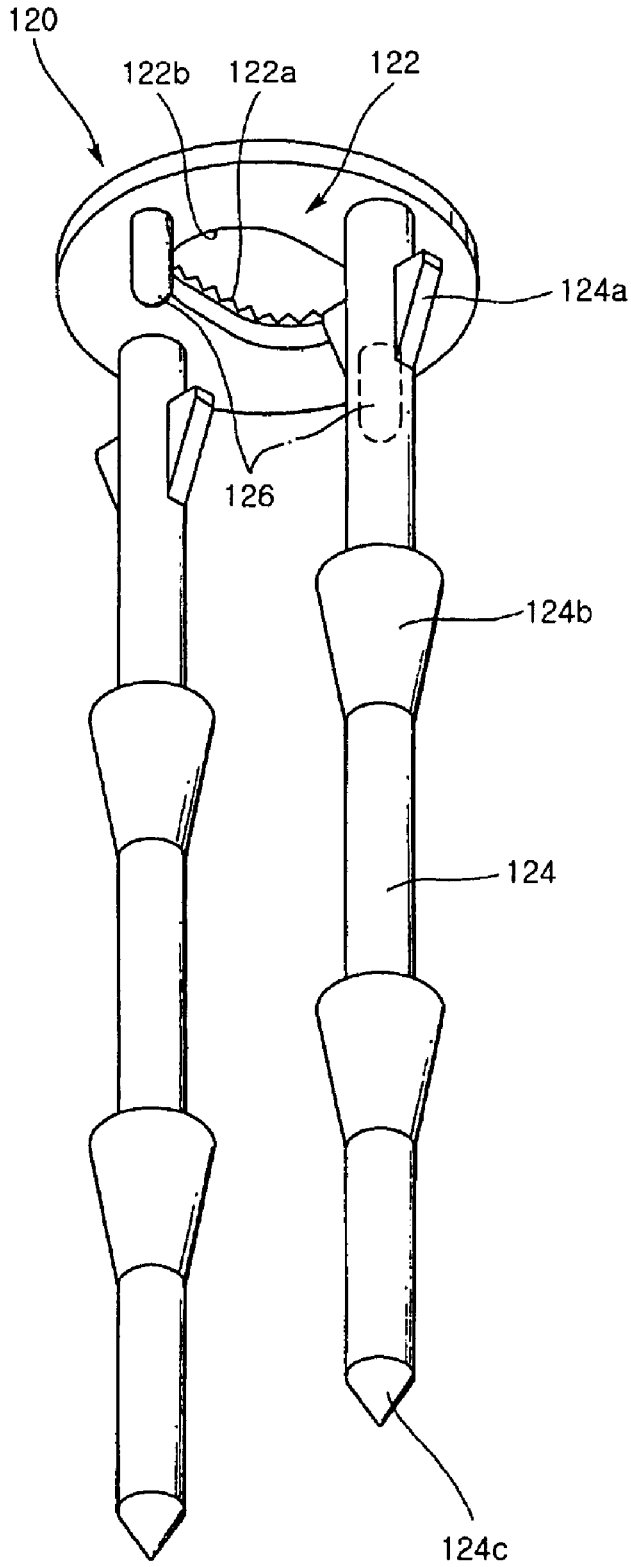

[Fig. 21]
(a)
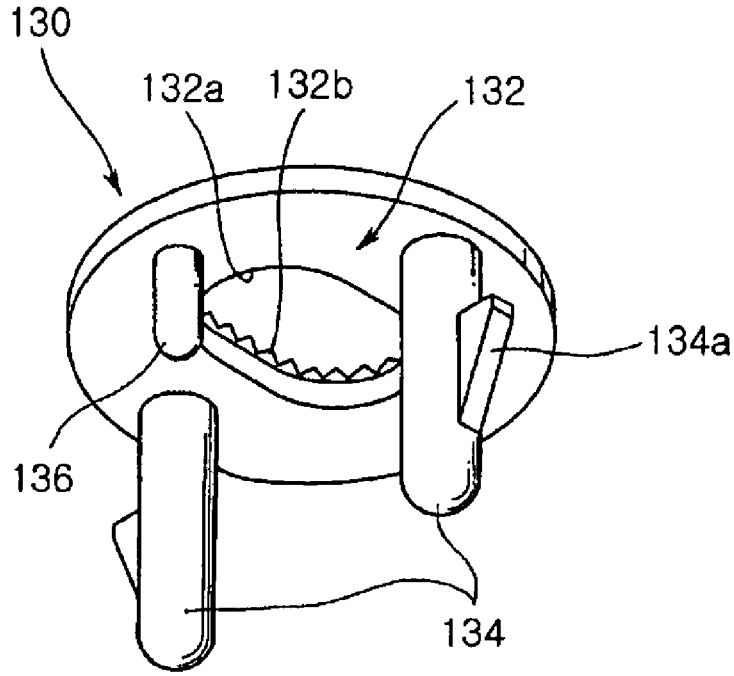
(b)
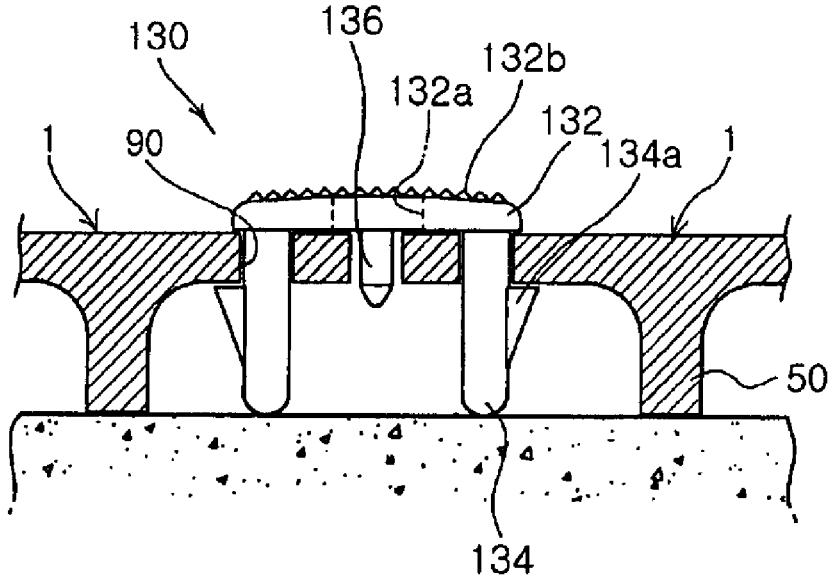

[Fig. 22]
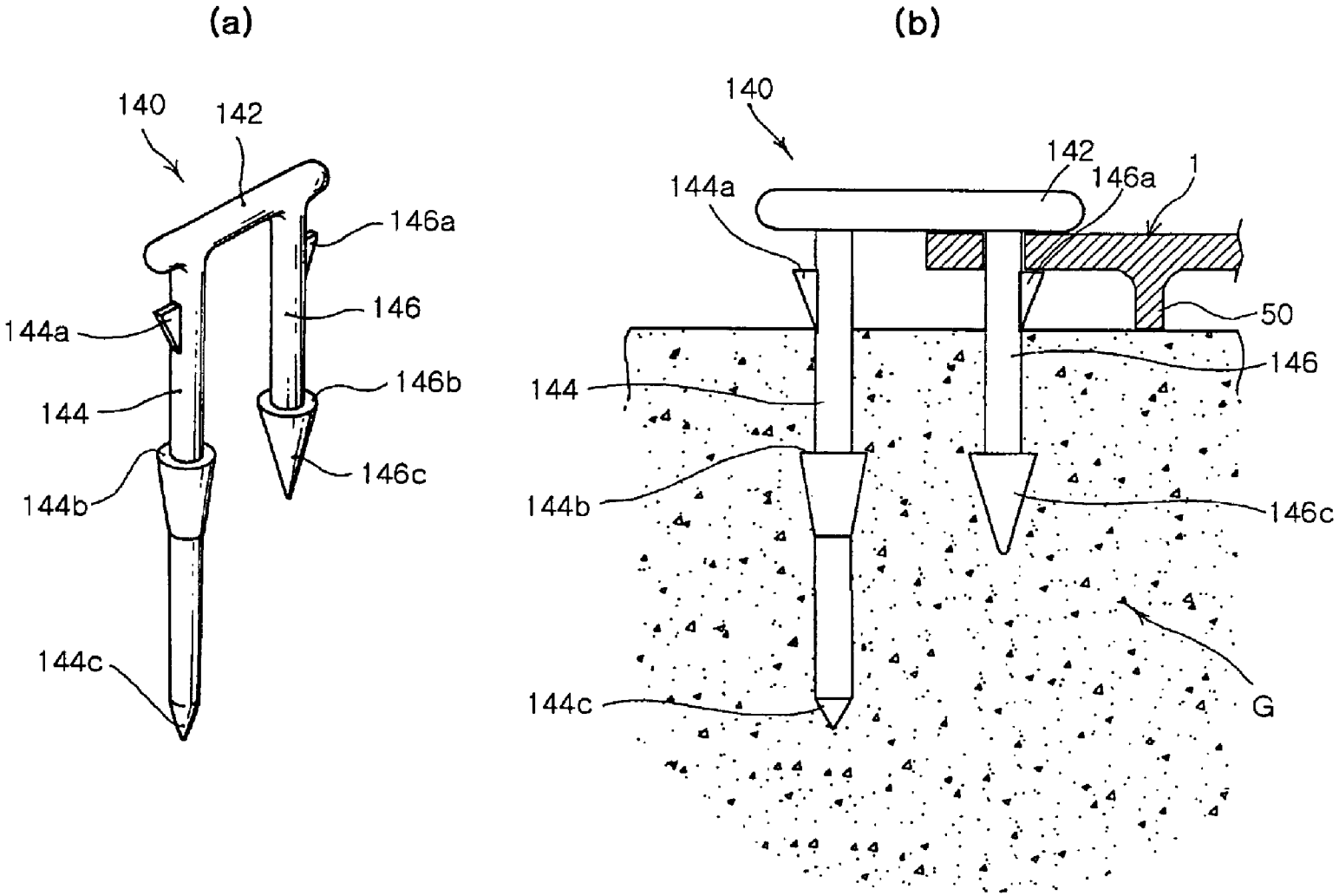

[Fig. 23]
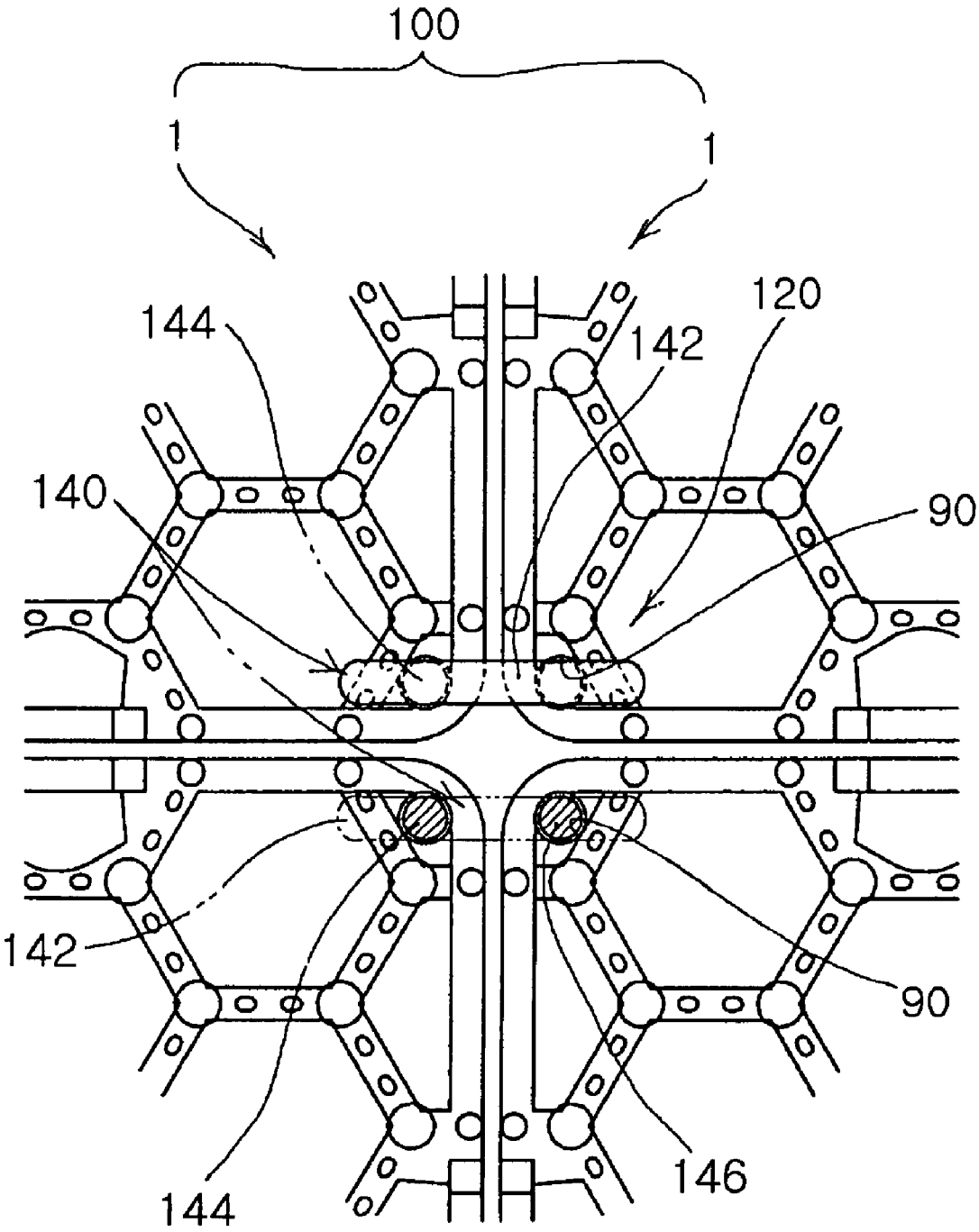

GRASS PROTECTION MAT AND MAT ASSEMBLY HAVING THE SAME

TECHNICAL FIELD

The present invention relates to a grass protection mat used for protection of grass in a golf course, a grass ballpark, and a lawn, and more particularly, to a grass protection mat which is easily interconnected with other mats and installed on the ground and which does not sink easily into the ground, and a mat assembly.

BACKGROUND ART

In the places where grass is grown, such as golf courses, grass ballparks or parks, grass is easily pressed down and damaged in the area which is subject to human or vehicular traffic (e.g. a golf cart). Repairing the damaged grass requires considerable amount of costs.

In order to uphold and buffer the load of people or vehicles in such an area, grass protection mats have been used, and these mats are well-known in general.

Although not shown in a separate diagram, a generally known conventional grass protection mat includes a body forming an overall structure of the mat, a lug member provided in the lower part of the body to be placed on the ground, a protruded pillar provided on the upper part of the body, for upholding the load, a buffer wing for dispersing and buffering the load, and an outer frame for maintaining the peripheral frame of the mat.

In addition, for connection of the mats, L-shaped hooks are provided in the outer frame to be fitted into the other outer frame or button-shaped hooks are provided in the adjacent outer frames to be fitted into each other.

In other words, in the conventional grass protection mat, the lug members and the protruded pillars uphold the load of the people or the vehicles passing on the mat while the buffer wings disperse the load, thereby protecting the grass rooted and grown under the mat from being damaged.

In the conventional grass protection mats known to date, simple L-shaped or button-shaped hooks are used to connect the mats, in which the operation is difficult and vertical pushing and fitting is inconvenient for actual connection of the mats.

Particularly, the conventional hooks are detached too easily from the outer frame of the mat when the mats are assembled.

In the meantime, the conventional grass protection mats (refer to FIG. 13) use wires to connect the corners of the mats, and thus the installation of the mats as well as separation of the mats for repair is difficult.

In addition, after the conventional mats are installed on the ground to protect grass, they sink into the ground over time, not effective in protection of the grass.

If the grass protection mat is sunk into the ground or sand is poured over the grass to protect the grass in the golf field, the height of the space for protecting the grass becomes lower, and protection of the grass becomes inefficient.

Therefore, there has been a need for a mat assembly having slide-type hooking means for conveniently connecting the mats in rows and lines, sinking prevention means for preventing the mats from sinking into the ground, and particularly, a mat fastening member for conveniently installing the mats on the ground.

DISCLOSURE OF INVENTION

Technical Problem

The present invention has been made to solve the foregoing problems of the prior art and it is therefore an object of the present invention to provide a grass protection mat, which is easily interconnected, assembled and installed, being effectively prevented from sinking into the ground after installation on the ground, and which accomodates protection as well as growth of grass, and a mat assembly.

Technical Solution

According to an aspect of the invention for realizing the object, the present invention provides a grass protection mat comprising: a body made of polygonal portions connected to each other, forming spaces for growing grass;

pillars integrally protruded upward from the body;

an outer frame connecting with the periphery of the body to maintain the shape of the mat;

lug members integrally protruded from lower parts of the body and the outer frame;

hooking means laterally protruded at the outer frame, for enabling connection of the mat, and an opening formed at the inner surface of the outer frame, for receiving hooking means of an another adjacent mat.

According to another aspect of the invention for realizing the object, the present invention provides a grass protection mat including: a body made of polygonal portions connected to each other, forming spaces for growing grass;

pillars integrally protruded upward from the body;

lug members integrally protruded from lower parts of the body and the outer frame; and a sinking prevention means provided in a lower part of the mat to prevent the mat from sinking into the ground.

According to another aspect of the invention for realizing the object, the present invention provides a mat assembly including: grass protection mats; and a mat fastening member fixedly connecting adjacent corners of the grass protection mats.

Advantageous Effects

According to the invention, the grass protection mat is effectively prevented from sinking into the ground after installed on the ground, and provides enhanced protection and growth of grass.

In addition, the mat assembly facilitates connection of the mats as well as installation of the mats on the ground where grass is actually grown and protected, thereby improving productivity in installation of the mats while saving the installation costs of the mats.

BRIEF DESCRIPTION OF THE DRAWINGS

FIG. 1 is a perspective view illustrating a grass protection mat according to the present invention;

FIG. 2 is a plan view of the grass protection mat shown in FIG. 1;

FIG. 3 is a side elevation view of the grass protection mat shown in FIG. 1;

FIG. 4 illustrates hooking means and an opening of the grass protection mat according to the present invention, in which, (a) is an exploded perspective view; and (b) is a perspective view illustrating the hooking means fastened into the opening;

FIG. 5 illustrates the hooking means fastened into the opening of the grass protection according to the present invention, in which, (a) is a plan view; and (b) is a front elevation view;

FIG. 6 illustrates a body, pillars and buffer wings of the grass protection mat of the present invention, in which, (a) is a plan view; and (b) is a plan view of the buffer wing;

FIG. 7 is a perspective view illustrating a reinforcement rib provided between lug members of the grass protection mat of the invention;

FIG. 8 is a view illustrating empty spaces in an extended arch-shape between the lug members of the grass protection mat of the invention;

FIG. 9 illustrates the grass protection mat of the invention composed of octagonal portions, in which, (a) is a plan view; and (b) is a side elevational view;

FIGS. 10(*a*) and 10(*b*) are perspective views illustrating sinking prevention means provided in the grass protection mat of the invention;

FIGS. 11(*a*) and 11(*b*) are perspective views illustrating other forms of sinking prevention means provided in the grass protection mat according to the present invention;

FIGS. 12(*a*) to (*c*) are perspective views illustrating further other forms of sinking prevention means provided in the grass protection mat according to the present invention;

FIG. 13 is a plan view illustrating a conventional mat assembly with mats bound together with wires;

FIG. 14 is a plan view illustrating a mat assembly in which the grass protection mat is assembled with a mat fastening member according to the present invention;

FIG. 15 is a front structural view of the mat assembly shown in FIG. 14;

FIG. 16 illustrates the mat fastening member used in the mat assembly according to the present invention, in which, (a) is a bottom perspective view; and (b) is a front view;

FIGS. 17(*a*) and 17(*b*) are bottom perspective views illustrating other forms of the mat fastening member shown in FIG. 16;

FIG. 18 is a plan view illustrating a mat assembly including another form of mat fastening member according to the present invention;

FIG. 19 is a front structural view of the mat assembly shown in FIG. 18;

FIG. 20 is a bottom perspective view illustrating the mat fastening member shown in FIG. 19;

FIG. 21 illustrates further another form of mat fastening member according to the present invention, in which, (a) is a bottom perspective view; and (b) is a front structural view illustrating usage of the fastening member;

FIG. 22 illustrates yet another form of mat fastening member according to the present invention, in which, (a) is a perspective view; and (b) is a front structural view illustrating usage of the fastening member; and FIG. 23 is a plan view illustrating other usage of the mat fastening member shown in FIG. 22*a*.

MODE FOR THE INVENTION

FIGS. 1 to 3 show the overall constitution of a grass protection mat 1 of the present invention.

The grass protection mat 1 of the present invention includes body portions 10, pillars 20, buffer wings 30, an outer frame 40, lug members 50, hooking means 60 and openings 70, which will be explained in detail below.

First, as shown in FIGS. 1 and 2, the hexagonal body portions 10 of the grass protection mat 1 are connected together to provide spaces as large as possible for growth of grass. The body portions 10 provide hexagonal grass reception areas 12 and constitute a frame for maintaining the strength of the mat.

The body portions 10 may also be composed of an octagonal shape as will be shown in the forthcoming FIG. 9 or a square shape although not shown in separate diagrams.

The hexagonal body portions 10 provide the grass reception areas 12 of maximum space for the grass to be protected and grown in the facilitated photosynthetic condition.

FIGS. 1 and 3 show the lug members 50 integrally protruded from the underside of the body portions 10 and the outer frame 40 of the grass protection mat 1.

The lug members 50 together with the pillars 20 of the present invention uphold the load of the passing people or automobiles (e.g. a golf cart), preventing the damage to the mat or the damage to the grass from being pressed.

The lug members 50 are disposed apart in a predetermined interval on the underside of the body portions 10 and the outer frame 40, and most preferably disposed on the cross-connection points of the body portions 10.

For example, the hexagonal body portions 10 have more cross-connection points than the square body portions, and thus are provided with increased number of lug members 50.

Next, FIGS. 1 to 3 show the pillars 20 and the buffer wings 30 protruded upward from the grass protection mat 10 of the present invention.

As shown in FIGS. 1 and 2, the pillars 20 of the invention are integrally protruded upward from the body portions 10, upholding the load. It is preferable also that the pillars 20 are disposed on the cross-connection points of the body portions 10, same as the lug members 50.

In addition, as shown in FIG. 1, it is preferable that the pillar 20 has a reinforcement part 20*a* having an expanded circumference toward the lower part thereof to have enhanced strength for upholding the load.

The strength of the pillars become weak over the time the grass protection mat is used, and the reinforcement part functions to compensate for the weakening strength of the pillars.

The buffer wings 30 are integrally protruded upward from the body 10 between the pillars 20 and formed taller than the pillars 20. Therefore, as people or automobiles pass on the mat, most of the load is upheld by the pillars and the lug members while the buffer wings 30 disperse the load, buffering the vertical impact on the grass.

As shown in FIG. 3, the buffer wings 30 are disposed on the major part of the body portions 10 and also have the tallest height on the mat, and thus are the parts that first come into contact with the shoes of the people or the wheels of the automobile.

Therefore, although not shown in a separate drawing, it will be preferable that buffer wings 30 have knurled surfaces to prevent slipping.

For example, a golfer walking on the grass protection mat in the early morning when it dews will be prevented from slipping.

FIGS. 1 and 2 show the outer frame 40 of the grass protection mat 1 of the present invention.

As shown in FIGS. 1 and 2, the outer frame 40 of the invention is in a square or a rectangular shape formed by integral connection of the body portions 10, maintaining the overall frame of the mat.

Preferably, as shown in FIG. 1, a reinforcement rib 42 is provided in the lower part of each corner of the outer frame 40.

Next, FIGS. 4 and 5 show the slide-type hooking means 60 and the fastening opening 70, in which the hooking means 60 is inserted into the fastening opening. The slide-type hooking means 60 and the fastening openings 70 are disposed on both left and right sides, facing each other across the mat.

The slide-type hooking means 60 protrude laterally from a plurality of points of the outer frame 40. Each of the slide-type hooking means 60 includes a body 64 having a cutout 62 for resilient operation and a hook 66 extended downward from the lower part of the body 64 beyond the outer frame 40.

Although not shown in a separate drawing, most of the conventional grass protection mats use simple L-shaped (or button type) hooking means. The mats are connected by pressing the hooking means provided in the outer frame of one mat into the outer frame of an adjacent mat by fingers, which is inconvenient and time-consuming.

Particularly, the hooks are frequently detached from the outer frame in the conventional mats.

On the other hand, in the grass protection mat of the present invention, the slide-type hooking means 60 are easily fastened into the fastening openings 70 in the corresponding positions. Further, once they are fastened, they are not easily detached, which enables convenient and secure assembly of the grass protection mats 1 in rows and lines.

Therefore, the grass protection mat 1 of the present invention shortens the assembly time of the mats, reducing the installation costs as well as improving overall assemblability of the mats, and the installed structure of the mats remains solid once installed.

In the meantime, the fastening opening 70, which receives the slide-type hooking means 60 includes a fastening hole 74 in an extension plate 72. A plurality of the extension plates 72 are integrally formed on a plurality of points of the outer frame 40, in the corresponding positions of the hooking means of the adjacent mat. The fastening opening also include a guiding groove 76 that enables slide insertion of the hooking means 60 into the fastening hole 74.

Therefore, as shown in FIG. 4, with the hooking means 60 aligned with the fastening opening 70 of the grass protection mat, the hook 66 of the hooking means 60 is moved along the guiding groove 76 to be fastened into the fastening opening 70.

At this time, as shown in FIG. 5, the hook 66 is moved forward in a constricted state by the cutout 62 of the body 64, and when it reaches the fastening hole 74 of the opening 70, the hook 66 slides easily into the fastening hole 74 and gets hitched on the underside of the extension plate 72.

As shown in FIG. 4(*a*), the extension plate 72 having the fastening hole 74 of the opening 70 is a plate integrally extended from the body portion 10 toward the periphery of the outer frame 40 to a point of the outer frame 40 of the mat.

FIG. 6 shows the buffer wings 30 of the grass protection mat 1 of the present invention in detail.

The buffer wing 30' of the conventional grass protection mat has sharp edges whereas the buffer wing 30 of the grass protection mat 1 of the present invention has rounded edges with a hemisphere-shaped section as shown in FIG. 6(*b*).

Therefore, the grass protection mat 1 of the present invention can effectively prevent damage to the grass, such as in the case where the grass may be cut by the sharp edges of the buffer wing.

In addition, as shown in FIG. 6(*a*), two buffer wings 30 are integrally protruded upward from the body portion 10 in each interval between the pillars 20 and have cutout surfaces 30*a* facing opposite sides. Therefore, when the buffer wings 30 are pressed, they are bent in opposite directions, thereby allowing buffering by dispersing the load more extensively.

Next, FIGS. 7 and 8 show the lug members 50, in which FIG. 7 shows reinforcement ribs 52 integrally formed between the lug members 50, and FIG. 8 illustrates empty spaces 54 between the lug members 50.

As shown in FIG. 7, the reinforcement ribs 52 integrally formed between the lug members 50 are disposed apart in a regular interval, enhancing the strength of the grass protection mat.

As shown in FIG. 8, the empty space 54 formed between the lug members 54 is arch-shaped to obtain a maximum space to minimize pressing onto the grass.

Therefore, the grass protection mat 1 of the present invention prevents damage to grass as much as possible, facilitating rooting and growing of the grass, thereby effectively protecting grass.

With reference to FIG. 9, a grass protection mat 1' having octagonal body portions 10 is shown.

In this case, as shown in FIG. 9, the octagonal body portions 10 form spaces A, and thus are less efficient than the hexagonal body portions in terms of space utilization.

Although not shown in a separate drawing, the body portion 10 may also have a rectangular shape.

Therefore, the body portions 10 may be composed of any one of rectangular, hexagonal or octagonal shapes, of which the hexagonal shape is most preferable.

The grass protection mat 1 can be injection-molded by resilient material such as synthetic resin or synthetic rubber, and corrosion resistant material such as polyethylene.

FIGS. 10 to 12 show sinking prevention means additionally provided in the grass protection mat 1.

The sinking prevention means prevent the grass protection mat from sinking into the ground after installation on the ground, and can be provided in various forms.

For example, FIG. 10(*a*) (refer to FIG. 3) shows a cylinder 80*a* for the sinking prevention means.

The cylinder 80*a* is provided in a hollow cylindrical shape in a lower part of the lug member 50 of the body 10, with soil filling inner space of the cylinder, preventing the mat from sinking into the ground.

FIG. 10(*b*) illustrates a bar 80*b* for the sinking prevention means.

The bars 80*b* are integrally formed between lower parts of the lug members 50.

It is preferable that the bottom surface of the bar 80*b* is formed planar as it touches the ground whereas the upper surface of the bar 80*b* is rounded to prevent damage to grass by contacting the upper surface.

Therefore, the bars 80*b* further facilitate the manufacturing of the grass protection mats compared with the cylinders 80*a*, and also prevent sinking of the mat.

Next, FIG. 11(*a*) shows a circular plate 80*c* for the sinking prevention means.

The circular plate 80*c* having a small thickness are integrally provided on lower parts of the lug members, forming an enlarged contact surface with the ground, thereby preventing the mat from sinking into the ground.

At this time, it is preferable that the circular plate 80*c* is further extended to a position beyond the lowermost end of the lug member 50, so it is the lug member that touches the ground.

FIG. 11(*b*) shows a rounded plate 80*d* for the sinking prevention means of the grass protection mat 1.

The rounded plate 80*d* is provided in a lower part of the reinforcement plate 82 integrally provided between the lug members 50, with a reinforcement rib 82*a* provided at the side surface of the reinforcement plate 82.

Thereby, the circular plates and the rounded plates prevent the grass protection mat from sinking into the ground.

FIG. 12(*a*) shows narrowed end portions formed at the lower ends of the lug members for the sinking prevention means 80*e*.

The circumference of the lower part of the lug member is constricted, forming a stepped portion to prevent the mat from sinking.

FIGS. 12(*b*) and 12(*c*) show a fastening type wire 80*f* and a fastening type bar 80*g*, respectively, for the sinking prevention means.

The fastening type wire and bar 80*f*,80*g* are detachable from the lug members, and thus can be disposed on the ground for installation, in a desired position underneath the grass protection mat 1.

As described above, the sinking prevention means 80*a* to 80*g* prevent the grass protection mat 1 of the present invention from excessively sinking into the ground.

For example, in the case of covering grass with sand to accommodate growth of the grass in the golf field or during the rainy season when the ground is soft, the lug members 50 of the grass protection mat 1 tend to sink into the ground.

As the lug member is sunk deeper into the ground, the height of the grass protection mat becomes lower, and therefore, the mat cannot carry out the function of protecting the grass, which is the problem the grass protection mat of the present invention aims to solve.

FIGS. 14 to 23 show a mat assembly 100 and several forms of mat fastening members 110, 120, 130, 140 used for assembling the mats according to the present invention.

FIG. 13 shows a conventional mat assembly 100', in which a wire S is wound on the fastening holes 90 of the mat corners, connecting the mat corners.

In the conventional mat assembly 100', it may be possible to connect the mats in rows and lines using hooks but since the mat corners are connected by a wire, the connection procedure is difficult. Moreover, the wire that connects the corners becomes rusty, which is not aesthetically pleasing, and particularly, the separation of the mats for repair is difficult.

FIGS. 14 to 17 show a mat fastening member and a mat assembly 100 using the same of the present invention which aims to solve the adverse effects from using the conventional wire S (FIG. 13).

That is, the mat fastening member used for the mat assembly 100 is inserted in the ground, fixing the fastening holes 90 of the mat corners, thereby enhancing the assemblability of the mat assembly.

FIG. 16 shows the mat fastening member 110, which includes a compressing member 112, a pillar member 114 integrally formed in the center of a lower part of the compressing member, is inserted in the ground through the space between the mat corners. Also, a plurality of fixing pins 116 formed in a peripheral portion of the lower part of the compressing member, are fixedly inserted into the fastening holes 90 of the mat corners.

Therefore, as shown in FIGS. 14 and 15, the pillar member 114 of the mat fastening member 110 penetrates the space between mat corners to be stably inserted in the ground G.

At this time, the mat corners are fixed by compressing member 112 as the fixing pins 116 are fixedly inserted into the fastening holes of the mat corners at the same time, thereby enabling stable assembly of the mats.

As shown in FIG. 16, it is preferable that the upper part of the circular plate-shaped compressing member 112 has a knurled surface 112*a* to prevent slipping.

Therefore, when using the mat assembly, first, the hooking means 60 are inserted into the fastening openings 70 of the grass protection mats 1 to connect the mats in rows and lines. Then, the mat fastening members 110 compress the mat corners with the compressing member thereof as the pillar members are inserted in the ground to complete simple and stable assembly of the mats.

As shown in FIGS. 15 and 16, supporting projections 114*a* are formed in the upper part of the pillar member 114, supporting the lower part of the mat corners, and thus the mats are prevented from being lifted individually.

The pillar member 114 has at least one detachment prevention step 114*b* and once the pillar member 114 is inserted in the ground G, the mat fastening member is not easily detached from the ground, stably maintaining the mat assembly.

Also, the lower end of the pillar member 114 forms a cone portion 114*c*, facilitating the insertion of the pillar member into the ground.

FIG. 17(*a*) shows a variation 110' of the mat fastening member in which the compressing member 112' is in a cross shape.

In this case, the area that covers the grass is decreased from the circular plate-shaped compressing member 112, increasing the exposure of the grass to the sunlight, thereby facilitating photosynthesis reaction.

On the other hand, FIG. 17(*b*) shows another variation 110" of the mat fastening member which is varied in the shape of the pillar member.

That is, the pillar member 114' has a cross-shaped section, which prevents the pillar member from being turned around after being inserted in the ground.

FIGS. 18 to 20 show other forms of mat fastening members 120, in which the difference lies in the fact that pillar members 124 and a fixing pin 126 are inserted into the respective fastening holes 90, in the mat corners.

That is, in the above described mat fastening member 110 shown in FIG. 16, only one pillar member 114 is inserted in the ground through the space between the mat corners. But in this mat fastening member 120, two or more pillar members 124 are inserted in the ground through the fastening holes 90 formed in the mat corners.

In this case, as the pillars are inserted in the ground through the mats, installation of the mat to the ground is more stable.

As shown in FIGS. 19 and 20, the compressing member 122 of the mat fastening member 120 may have a hole 122*b* in the central portion, and the upper surface thereof may be a knurled surface 122*a*, which will prevent slipping and at the same time allow sunlight through the hole 122*b*, facilitating photosynthesis of the grass.

At this time, the pillar member 124 may have a supporting projection 124*a*, a detachment prevention step 124*b* and a cone portion 124*c*, which have the same operations as described above.

Next, FIG. 21 illustrates another form of mat fastening member 130 used for the mat assembly of the present invention.

The pillar member 124 of this mat fastening member 130 is shortened in its length so that the mat fastening member 130 is not inserted in the ground.

The mat fastening member 130 shown in FIG. 21 includes a circular plate-shaped compressing member 132 and a pair of first fixing pins 134 opposed to each other on a lower part of the compressing member, inserted into first fastening holes 90 of the mats to connect the mats. The mat fastening member 130 further includes a pair of second fixing pins 136 opposed to each other on the opposite side of the first fixing pins on the lower part of the compressing member, being fixedly inserted into second fastening holes 90 of the mats, which are not occupied by the first fixing pins.

Particularly, the fixing pins are adjusted in their length to conform to the length of the lug members of the mat 1, ensuring the height to such a degree that the fastening members are not inserted in the ground.

At this time, a supporting projection 134*a* is integrally provided on the first fixing pin 134, preventing detachment of the mat fastener from the mat.

As shown in FIG. 21(*a*), the compressing member 132 has an opening 132*a* which preferably is formed in an oval shape to allow enhanced passage of sunlight.

As shown in FIG. 21(*b*), the upper part of the compressing member 132 may have an integrally formed knurled surface 132*b* to prevent slipping.

The first fixing pins 134 correspond to the pillar members in FIG. 20 and the second fixing pin 136 corresponds to the fixing pin 126 in FIG. 20. The first and second fixing pins differ in circumference.

Compared with the pillar members 114, 124 of the mat fastening members 110, 120 inserted in the ground G, the mat fastening member 130 has shortened lengths of the fixing pins so that they are not inserted in the ground, allowing faster connection of the mats.

At this time, in order not to allow insertion of the first and second fixing pins into the ground, the length of the first and second fixing pins can be adjusted to conform to the length of the lug members 50 of the mat.

The mat fastening member 130 may be used in combination with other mat fastening members 110, 120, so that not all mat fastening members need to be inserted in the ground, facilitating the assembly process of the mats.

FIGS. 22 and 23 illustrate further another form of mat fastening member 140 according to the present invention.

This mat fastening member 140 includes a pressing handle 142 for pressing the corners of the mats, and first and second pillar members 144 and 146 integrally provided from both sides of a lower part of the pressing handle, being inserted in the ground either directly or through the mat fastening holes 90.

At this time, the pillar member 144, 146 includes at least one supporting projection 144*a*, 146*a*, detachment prevention step 144*b*, 146*b* and cone portion 144*c*, 146*c*, which have the same operations as described above.

Therefore, as shown in FIG. 22(*b*), the mat fastening member 140 has the second pillar member inserted in the ground through the fastening hole 90 of the corner of the grass protection mat 1 and the first pillar member 144 inserted directly into the ground without penetrating through the mat.

Alternatively, as shown in FIG. 23, the mat fastening member 140 may be used to fixedly connect the corners of the grass protection mats 1.

In the mat fastening members 110, 120 described hereinabove, fixing pins or pillar members are inserted into the fastening holes 90 of the grass protection mats 1 diagonally adjacent to each other. On the other hand, the mat fastening members 140 in FIG. 22*a* fixedly connect through the fastening holes 90 of the mats horizontally adjacent to each other.

Therefore, the grass protection mat 1 of the present invention and the mat assembly may use one or combinations of the various mat fastening members 110, 120, 130, 140 to enhance assemblability of the mats.

In addition, the grass protection mat 1 itself has many advantages as explained hereinabove.

INDUSTRIAL APPLICABILITY

The grass protection mat and the mat assembly stably protect grass, facilitating the installation of the mat assembly, thereby facilitating its use in the actual golf field and the lawn in the park.

While the present invention has been shown and described in connection with the preferred embodiments, it will be apparent to those skilled in the art that modifications, and variations can be made without departing from the spirit and scope of the invention as defined by the appended claims.

The invention claimed is:

1. A grass protection mat system comprising: at least one mat, each mat comprising:

a body made of polygonal portions connected to each other, forming spaces for growing grass;

pillars integrally protruded upward from the body;

an outer frame connecting with the periphery of the body to maintain the shape of the mat;

lug members integrally protruded from lower parts of the body and the outer frame;

hooking means laterally protruded at the outer frame, for enabling connection of the mat, and an opening formed at the inner surface of the outer frame, for receiving hooking means of an another adjacent mat, wherein the opening of the mat includes a fastening hole formed through an extension plate integrally and laterally formed on a point of the outer frame and disposed inside of the outer frame, in a corresponding position of the hooking means of the another adjacent mat, wherein an opening of an adjacent mat includes a fastening hole formed through an extension plate integrally and laterally formed on a point of an outer frame of the adjacent mat, in a corresponding position of the hooking means of the mat, wherein the hooking means of the mat is of a slide-type mechanism including:

bodies laterally protruded from a plurality of regions of the outer frame of the mat and extended downward, each having a cutout perpendicularly formed through a corresponding one of the bodies for resilient operation, and hooks integrally protruded outwardly from both sides of lower parts of the bodies, wherein some of the hooks of the mat are fixedly inserted through, and extend below, the fastening hole of the adjacent mat, and wherein upper surfaces of the some of the hooks are supported by, and in contact with, an underside of the extension plate of the adjacent mat, and wherein the opening of the mat further includes a guiding groove that is formed on the fastening hole of the opening of the mat and enables slide insertion of the hooking means of the another adjacent mat securely into the fastening hole of the opening of the mat, the guiding groove further enables the hook of the hooking means to be moved along to be fastened into the opening.

2. The grass protection mat system according to claim 1, wherein the polygonal portions comprise one selected from a group consisting of rectangle, hexagon and octagon.

3. The grass protection mat system according to claim 1, each mat further comprising buffer wings integrally protruded upward from the body in the space between the pillars.

4. The grass protection mat system according to claim 1, each mat further comprising a sinking prevention means provided in a lower part of the mat to prevent the mat from sinking into the ground.

5. The grass protection mat system according to claim 1, wherein the guiding groove enables the hook of the hooking means to be moved along in a constricted state to be fastened into the opening.

6. The grass protection mat system according to claim 4, wherein the sinking prevention means comprise rounded plates each perpendicularly and integrally formed at a lower part of a corresponding one of reinforcement plates integrally formed between the lug members, to increase sinking prevention effects of the mat by ground contacts of the rounded plates.

7. A grass protection mat comprising:

a body made of polygonal portions connected to each other, forming spaces for growing grass;

pillars integrally protruded upward from the body;

lug members integrally protruded from lower parts of the body and the outer frame; and sinking prevention means provided in a lower part of the mat to prevent the mat from sinking into the ground, wherein the sinking prevention means comprise rounded plates each perpendicularly and integrally formed at a lower part of a corresponding one of reinforcement plates integrally formed with and between two adjacent ones of the lug members, to increase the sinking prevention effects of the mat by ground contacts of the rounded plates, wherein the sinking prevention means further comprise reinforcement ribs, each of the reinforcement ribs integrally formed between a corresponding one of the reinforcement plates and a corresponding one of the rounded plates, the reinforcement ribs disposed perpendicular to the reinforcement plate and the rounded plate, wherein each of the reinforcement plates extends vertically from a lower end part of the lug members to, and is in direct contact with a bottom side of the body, and wherein each of the rounded plates is large enough in size so that each of the rounded plates is in direct contact with two adjacent lug members.

8. The grass protection mat according to claim 7, further comprising:

buffer wings integrally protruded upward from the body in the space between the pillars; and an outer frame connecting with the periphery of the body to maintain the shape of the mat.

9. The grass protection mat according to claim 8, further comprising:

hooking means laterally protruded at the outer frame, for enabling connection of the mat; and an opening formed at the inner surface of the outer frame, for receiving hooking means of an another adjacent mat.

10. The grass protection mat according to claim 9, wherein the hooking means are of a slide-type mechanism including:

bodies laterally protruded from a plurality of regions of the outer frame and extended downward, each having a cut-out perpendicularly formed through a corresponding one of the bodies for resilient operation; and hooks integrally protruded outwardly from both sides of lower parts of the bodies to be fixedly inserted into fastening holes of corresponding openings of an adjacent mat.

11. The grass protection mat according to claim 9, wherein the opening includes:

a fastening hole formed through an extension plate integrally and laterally formed on a point of the outer frame, in a corresponding position of the hooking means of the another adjacent mat; and a guiding groove that is formed on the fastening hole and enables slide insertion of the hooking means of the another adjacent mat into the fastening hole of the opening.

12. The grass protection mat according to claim 7, wherein the polygonal portions comprise one selected from a group consisting of rectangle, hexagon and octagon.

13. The grass protection mat according to claim 7, wherein round plate that is integrally formed on the each of the reinforcement plates is disposed between the two adjacent lug members.

14. The grass protection mat according to claim 7, wherein each of the reinforcement plates is integrally formed with only one corresponding one of the rounded plates.

15. The grass protection mat according to claim 7, wherein each pair of the lug members is integrally formed with only one corresponding one of the rounded plates.

* * * * *